US010085914B2

(12) United States Patent
Murison

(10) Patent No.: US 10,085,914 B2
(45) Date of Patent: Oct. 2, 2018

(54) METHODS AND DEVICES RELATING TO VIBRATORY IMPACT ADULT DEVICES

(71) Applicant: Obotics Inc., North Gower (CA)

(72) Inventor: Bruce Murison, North Gower (CA)

(73) Assignee: Obotics Inc., North Gower (CA)

( * ) Notice: Subject to any disclaimer, the term of this patent is extended or adjusted under 35 U.S.C. 154(b) by 441 days.

(21) Appl. No.: 14/800,761

(22) Filed: Jul. 16, 2015

(65) Prior Publication Data

US 2016/0015596 A1 Jan. 21, 2016

Related U.S. Application Data

(60) Provisional application No. 62/025,532, filed on Jul. 17, 2014.

(51) Int. Cl.
*A61H 19/00* (2006.01)
*A61H 23/02* (2006.01)

(52) U.S. Cl.
CPC ..... *A61H 23/0263* (2013.01); *A61H 19/30* (2013.01); *A61H 19/34* (2013.01); *A61H 19/44* (2013.01); *A61H 2201/0153* (2013.01); *A61H 2201/14* (2013.01); *A61H 2201/1472* (2013.01)

(58) Field of Classification Search
CPC ..... A61H 19/30; A61H 19/34; A61H 19/44; A61H 2201/0153; A61H 2201/14; A61H 2201/1472; A61H 23/0263
See application file for complete search history.

(56) References Cited

U.S. PATENT DOCUMENTS

| | | | |
|---|---|---|---|
| 4,722,327 | A | 2/1988 | Harvey |
| 4,790,296 | A | 12/1988 | Segal |
| 5,076,261 | A | 12/1991 | Black |
| 5,501,650 | A | 3/1996 | Gellert |
| 5,573,499 | A | 11/1996 | McAllister |
| 5,690,604 | A | 11/1997 | Barnett |
| 5,851,175 | A | 12/1998 | Nickell |
| 6,142,929 | A | 11/2000 | Padgett |
| 6,866,645 | B2 | 3/2005 | Lee |
| 6,899,671 | B1 | 5/2005 | Fontenot |
| 6,902,525 | B1 | 6/2005 | Jewell |
| 7,108,668 | B2 | 9/2006 | Fang |
| 7,166,072 | B2 | 1/2007 | Smith |

(Continued)

*Primary Examiner* — Christine H Matthews
(74) *Attorney, Agent, or Firm* — Rosenberg, Klein & Lee

(57) ABSTRACT

Small high efficiency motors in order to produce large amounts of power must be operated such that they are running at high speed outside the desired vibration range for sexual stimulation. Accordingly, designs allowing for the appropriate gearing to allow heavy weights to be spun with small diameter and high efficiency whilst not increasing the outer diameter of an adult device are disclosed. Beneficial embodiments of the invention provide users with adult devices providing high impact (amplitude) vibration in a range of physical geometries compatible with providing internal and/or external stimulation which can also be offered at low cost and/or low manufacturing cost with extended operating life. Additionally, design flexibility via axial designs, non-axial designs, flexible drive designs, aperiodic drive designs, and linearly driven designs provide design solutions for implementing vibrators with low cost, high impact, targeted frequency characteristics, increased efficiency, and increased power.

15 Claims, 22 Drawing Sheets

(56) References Cited

U.S. PATENT DOCUMENTS

| | | | |
|---|---|---|---|
| 7,438,681 | B2 | 10/2008 | Kobashikawa |
| 7,452,326 | B2 | 11/2008 | Fladl |
| 7,524,283 | B1 | 4/2009 | Ohnstone |
| 7,604,587 | B2 | 10/2009 | Manska |
| D605,779 | S | 12/2009 | Murison |
| 7,670,280 | B2 | 3/2010 | Gloth |
| 7,871,386 | B2 | 1/2011 | Nan |
| 7,931,605 | B2 | 4/2011 | Murison |
| 7,967,740 | B2 | 6/2011 | Mertens |
| D652,942 | S | 1/2012 | Murison |
| 8,109,869 | B2 | 2/2012 | Beaulieu |
| 2002/0103415 | A1 | 8/2002 | Manska |
| 2003/0195441 | A1 | 10/2003 | Firouzgar |
| 2004/0082831 | A1 | 4/2004 | Kobashikawa |
| 2004/0147858 | A1 | 7/2004 | Lee |
| 2005/0033112 | A1 | 2/2005 | Bruton |
| 2006/0074273 | A1 | 4/2006 | Smith |
| 2006/0106327 | A1 | 5/2006 | Thielen |
| 2006/0247493 | A1 | 11/2006 | Chen |
| 2007/0055096 | A1 | 3/2007 | Berry |
| 2007/0232967 | A1 | 10/2007 | Driscoll |
| 2007/0244418 | A1 | 10/2007 | Harkness |
| 2008/0071138 | A1 | 3/2008 | Mertens |
| 2008/0082028 | A1 | 4/2008 | Blevins |
| 2008/0119767 | A1 | 5/2008 | Berry |
| 2008/0139980 | A1 | 6/2008 | Fladl |
| 2009/0318755 | A1 | 12/2009 | Adams |
| 2010/0292531 | A1 | 11/2010 | Beaulieu |
| 2011/0009693 | A1 | 1/2011 | Borrero |
| 2011/0034837 | A1 | 2/2011 | Lee |
| 2011/0082332 | A1 | 4/2011 | Lee |
| 2011/0087141 | A1* | 4/2011 | Wagy ..... A61H 15/0085 601/137 |
| 2011/0105837 | A1 | 5/2011 | Lee |
| 2011/0124959 | A1 | 5/2011 | Murison |
| 2011/0166415 | A1 | 7/2011 | Zamar |
| 2011/0218395 | A1 | 9/2011 | Stout |
| 2011/0319707 | A1 | 12/2011 | Mertens |
| 2012/0179077 | A1 | 7/2012 | Tuck |
| 2012/0184884 | A1 | 7/2012 | Dyer |
| 2012/0197072 | A1 | 8/2012 | Cordle |

* cited by examiner

METHODS AND DEVICES RELATING TO VIBRATORY IMPACT ADULT DEVICES

CROSS-REFERENCE TO RELATED APPLICATIONS

This patent application claims the benefit of U.S. Provisional Patent Application 62/025,532 filed on Jul. 17, 2014 entitled "Methods and Devices Relating to Vibratory Adult Devices," the entire contents of which are included herein by reference.

FIELD OF THE INVENTION

The present invention relates to devices for sexual pleasure and more particularly to adult devices providing higher amplitude vibrations, aperiodic stimulation, and exploiting high speed motors for reduced cost.

BACKGROUND OF THE INVENTION

The sexual revolution, also known as a time of "sexual liberation", was a social movement that challenged traditional codes of behavior related to sexuality and interpersonal relationships throughout the Western world from the 1890s to the 1980s. However, its roots may be traced back further to the Enlightenment and the Victorian era in the Western world and even further in the Eastern world. Sexual liberation included increased acceptance of sex outside of traditional heterosexual, monogamous relationships (primarily marriage) as well as contraception and the pill, public nudity, the normalization of homosexuality and alternative forms of sexuality, and the legalization of abortion.

At the same time the growing acceptance of sexuality and masturbation resulted in the growth of a market for sexual devices, also known as sex toys, and then with technology evolution the concepts of "cyber-sex," "phone sex" and "webcam sex." A sex toy is an object or device that is primarily used to facilitate human sexual pleasure and typically is designed to resemble human genitals and may be vibrating or non-vibrating. Prior to this shift there had been a plethora of devices sold for sexual pleasure, although primarily under euphemistic names and a pretense of providing "massage" although their history extends back through ancient Greece to the Upper Paleolithic period before 30,000 BC. Modern devices fall broadly into two classes: mechanized and non-mechanized, and in fact the American company Hamilton Beach in 1902 patented the first electric vibrator available for retail sale, making the vibrator the fifth domestic appliance to be electrified. Mechanized devices typically vibrate, although there are examples that rotate, thrust, and even circulate small beads within an elastomeric shell. Non-mechanized devices are made from a solid mass of rigid or semi-rigid material in a variety of shapes.

Not surprisingly many early mechanized devices within the prior art were primarily intended to automate the motion of penetrative intercourse. Such prior art includes for example U.S. Pat. Nos. 4,722,327; 4,790,296; 5,076,261; 5,690,604; 5,851,175; 6,142,929; 6,866,645; 6,899,671; 6,902,525; 7,524,283 and U.S. Patent Application 2004/0,147,858. In contrast to these mechanized devices producing repeated penetrative action, vibrators are used to excite the nerve endings in the pelvic region, amongst others, of the user such as those same regions of the vagina that respond to touch. For many users the level of stimulation that a vibrator provides is inimitable. They can be used for masturbation or as part of sexual activities with a partner. Vibrators may be used upon the clitoris, inside the vagina, inserted into the rectum, and against nipples either discretely or in some instances in combination through multiple vibratory elements within the same vibrator or through using multiple vibrators.

Vibrators typically operate through the operation of an electric motor wherein a small weight attached off-axis to the motor results in vibration of the motor and hence the body of the portion of the vibrator coupled to the electric motor. They may be powered from connection to an electrical mains socket but typically such vibrators are battery driven which places emphasis on efficiency to derive not only an effective vibration but one over an extended period of time without the user feeling that the vibrator consumes batteries at a high rate. For example, typical vibrators employ 2 or 4 AA batteries, which if of alkaline construction, each have a nominal voltage of 1.5V and a capacity of 1800 mAh to 2600 mAh under 500 mA drain. As such, each battery under such a nominal drain can provide 0.75 W of power for 3 to 5 hours such that a vibrator with 2 AA batteries providing such lifetime of use must consume only 1.5 W in contrast to less than 3 W for one with 4 AA batteries. More batteries consume more space within devices which are generally within a relatively narrow range of physical sizes approximating that of the average penis in penetrative length and have an external portion easily gripped by the user thereby complicating the design. Typically, toys that are large due to power requirements are not as successful as more compact toys.

Example of such vibrators within the prior art include U.S. Pat. Nos. 5,573,499; 6,902,525; 7,108,668; 7,166,072; 7,438,681; 7,452,326; 7,604,587; 7,871,386; 7,967,740 and U.S. Patent Applications 2002/0,103,415; 2003/0,195,441 (Wireless); 2004/0,082,831; 2005/0,033,112; 2006/0,074,273; 2006/0,106,327; 2006/0,247,493; 2007/0,055,096; 2007/0,232,967; 2007/0,244,418; 2008/0,071,138; 2008/0,082,028; 2008/0,119,767; 2008/0,139,980; 2009/0,093,673; 2008/0,228,114; 2009/0,099,413; 2009/0,105,528; 2009/0,318,753; 2009/0,318,755; 2010/0,292,531; 2011/0,009,693; 2011/0,034,837; 2011/0,082,332; 2011/0,105,837; 2011/0,166,415; 2011/0,218,395; 2011/0,319,707; 2012/0,179,077; 2012/0,184,884; and 2012/0,197,072.

Within these prior art embodiments of vibrators different approaches have been described to provide different stimulation mechanisms other than simple vibration. Some of these, such as rotating rows or arrays of balls, typically metal, have been commercially successful. However, others have not been commercially successful to date including, for example, the use of linear screw drive mechanisms to provide devices that adjust in length. Another approach has been to include a rotary motor with a profiled metal rod to either impact the device's outer body or provide rotary motion of the device head. Accordingly, today, a wide range of vibrators are offered commercially to users but most of them fall into several broad categories including:

Clitoral: The clitoral vibrator is a sex toy used to provide sexual pleasure and to enhance orgasm by stimulating the clitoris. Although most of the vibrators available can be used as clitoral vibrators, those designed specifically as clitoral vibrators typically have special designs that do not resemble a vibrator and are generally not phallic shaped. For example, the most common type of clitoral vibrators are small, egg-shaped devices attached to a multi-speed battery pack by a cord. Common variations on the basic design include narrower, bullet-shaped vibrators and those resembling an animal. In other instances, the clitoral vibrator forms part of a vibrator with a second portion to be inserted into the vagina wherein they often have a small animal, such as a rabbit, bear, or dolphin perched near the base of the penetrative vibrator and facing forward to provide clitoral stimulation at the same time with vaginal stimulation. Prior art for clitoral stimulators includes U.S. Pat. Nos. 7,670,280 and 8,109,869 as well as U.S. Patent Application 2011/0,124,959.

In some instances, such as the We-Vibe™, the clitoral vibrator forms part of a vibrator wherein another section is designed to contact the "G-spot." Prior art for such combined vibrators includes U.S. Pat. No. 7,931,605, U.S. Design Pat. Nos. 605,779 and 652,942, and U.S. Patent Application 2011/0,124,959.

Dildo-Shaped: Typically these devices are approximately penis-shaped and can be made of plastic, silicone, rubber, vinyl, or latex. Dildo is the common name used to define a phallus-like sex toy, which does not, however, provide any type of vibrations. But as vibrators have commonly the shape of a penis, there are many models and designs of vibrating dildos available including those designed for both individual usage, with a partner, for vaginal and anal penetration as well as for oral penetration, and some may be double-ended.

Rabbit: As described above these comprise two vibrators of different sizes. One, a phallus-like shaped vibrator intended to be inserted in the user's vagina, and a second smaller clitoral stimulator placed to engage the clitoris when the first is inserted. The rabbit vibrator was named after the shape of the clitoral stimulator, which resembles a pair of rabbit ears.

G-Spot: These devices are generally curved, often with a soft jelly-like coating intended to make it easier using it to stimulate the g-spot or prostate. These vibrators are typically more curved towards the tip and made of materials such as silicone or acrylic.

Egg: Generally small smooth vibrators designed to be used for stimulation of the clitoris or insertion. They are considered discreet sex toys as they do not measure more than 3 inches in length and approximately ¾ inches to 1¼ inches in width allowing them to be used discretely, essentially at any time.

Anal: Vibrators designed for anal use typically have either a flared base or a long handle to grip, to prevent them from slipping inside and becoming lodged in the rectum. Anal vibrators come in different shapes but they are commonly called butt plugs or phallus-like vibrators. They are recommended to be used with a significant amount of lubricant and to be inserted gently and carefully to prevent any potential damage to the rectal lining.

Vibrating Cock Ring: Typically a vibrator inserted in or attached to a cock ring primarily intended to enhance clitoral stimulation during sexual intercourse.

Pocket Rocket (also known as Bullet): Generally cylindrical in shape one of its ends has some vibrating bulges and is primarily intended to stimulate the clitoris or nipples, and not for insertion. Typically, a "pocket rocket" is a mini-vibrator that is typically about three to five inches long and which resembles a small, travel-sized flashlight providing for a discreet sex toy that can be carried around in a purse, pouch, etc. of the user. Due to its small dimension, it is typically powered by a single battery and usually has limited controls; some may have only one speed.

Butterfly: Generally describing a vibrator with straps for the legs and waist allowing for hands-free clitoral stimulation during sexual intercourse. Typically, these are offered in three variations, traditional, remote control, and with anal and/or vaginal stimulators, and are generally made of flexible materials such as silicone, soft plastic, latex, or jelly.

However, to date within the adult device industry as the majority of vibrators exploit the same core vibratory motors their performance despite a wide range of packaging, materials, colours, shapes, etc. is fundamentally the same. Referring to FIG. 1 there are depicted first to fourth vibrators 110 to 140 of standard vibrator and rabbit style designs together with butt plug 150 and pocket rocket 160 exploiting smaller vibrating elements and vibrating cock ring 180 and egg 170 with more compact vibrating elements again. Prause et al. in "Clinical and Research Concerns with Vibratory Stimulation: A Review and Pilot Study of Common Stimulation Devices" (Sexual & Relationship Therapy, 2012, pp. 1-8) tested a range of different vibrator designs resulting in the results presented in Table 1. Harder plastic vibrators (exemplified by vibrators 2 or 4 and first to fourth vibrators 110 to 140) yielded increased displacement with a range of performance through control settings versus vibrators with soft material with similar control setting options (exemplified by vibrator 6 and egg 170). Both of these exploit larger off-axis weights and motors to smaller vibrators (exemplified by vibrators 5 or 7 and pocket rocket 160) but these still achieved displacement and acceleration comparable to harder plastic vibrators due to the smaller vibrator impacting a lower mass hard outer body and performed within an overall range these vibrators but with less functionality, e.g. single setting.

TABLE 1

Vibrator Characteristics after Prause et al.

| | | Frequency (Hz) | | Displacement (μm) | | Acceleration (μg) | |
|---|---|---|---|---|---|---|---|
| | Vibrator | High | Low | High | Low | High | Low |
| 1 | Hitachi Wand | 101 | 89 | 452.9 | 452.4 | 185.7 | 143.8 |
| 2 | Hard Plastic Vibrator | 115 | 43 | 256.9 | 330.8 | 165.6 | 26.8 |
| 3 | Vibrator with Clitoral Cup | 69 | 30 | 719.7 | 783.3 | 137.8 | 29.2 |
| 4 | Egg | 98 | | 280.1 | | 114.2 | |
| 5 | Pocket Rocket | 148 | 108 | 82.1 | 92.3 | 73.1 | 43.1 |
| 6 | Soft Flower Vibrator | 128 | 63 | 164.4 | 161.7 | 109.2 | 25.7 |
| 7 | Butterfly | 115 | | 223.1 | | 123.5 | |

However, two vibrators stood outside the typical performance of vibrating motor adult devices. These were the vibrator 2, e.g. Hitachi Wand 1020 in FIG. 1, and vibrator 3, e.g. vibrator with clitoral cup. In both of these the displacement of the adult device was significantly higher at approximately 0.45 mm and 0.75 mm respectively versus the approximately 0.1 mm-0.3 mm within the other vibrators. Within studies women have typically expressed preference of Hitachi Wand type vibrators (e.g. vibrator 1) over conventional vibrators (e.g. vibrators 2 or 4) and accordingly the inventor has ascribed this to the higher amplitude vibration. Such higher amplitude vibration may be considered to mechanically be closer to physical stimulation from fingers, tongue etc. Additionally, adult devices as evident from the performance above do not overlap with the mechanoreceptors within humans wherein the clitoris is primarily comprised of Merkel disk receptors which within the prior art are most sensitive to vibrations between 5 Hz and 15 Hz (i.e. corresponding to mechanical vibratory motor operating at 300 RPM to 900 RPM), again frequencies more closely associated with manual and oral stimulation. In contrast, the penis is a combination of Pacinian and Ruffini mechanoreceptors which are sensitive to higher frequencies around 250 Hz (i.e. corresponding to mechanical vibratory motor operating at 15,000) and low frequency stretch.

However, prior art studies within laboratory environments have typically employed significantly lower displacements of approximately 0.002 mm for women and 0.005 mm-0.050 mm for men respectively and the frequency/amplitude measurements of Prause et al were "unloaded" in that they were not characterised with the application of force or pressure to hold the device against the desired area but it is anticipated that such mechanical loading would significantly reduce amplitude and lower frequency. In many instances users may find the limitations of the vibrator 2 approach, e.g. mains power with cable to a wall socket, difficult to overcome, may find the physical profile/geometry of the vibrator 2 approach intimidating and/or interfering with their use of the adult device. Similarly, vibrator 3 has limited functionality and the inventors anticipate tight positional requirements to exploit the desired effect upon the user's clitoris. Neither vibrator 2 nor vibrator 3 is suitable for penetration to access/stimulate the G-spot not support the common use of vibrators by users within their vagina and/or rectum.

Additionally, physical dimensions of many adult devices are limited; particularly the diameter, and accordingly designs exploiting axial motors with non-axial elements (e.g. off-axis weights) have held sway within commercial designs. Such a motor 1030 is depicted in FIG. 1 and is typical of vibratory motors for prior art vibrators and vibrating elements within adult devices such as deployed within vibrator 2 (first to fourth vibrators 110 to 140) and vibrator 5 (pocket rocket 160) are depicted.

In fact the experiences of users established by the inventor is that the vibration range of the motor within the vibrator yielding satisfactory response is in the unloaded scenarios between 2,000 RPM$\leq v_{VIBRATION} \leq$7,000 RPM. Whilst outside the ranges determined from clinical studies the vibratory amplitude of adult devices commercially is significantly higher than the very low amplitude clinical study vibrations. Further, users prefer large amplitude variation but it takes a lot of power (torque) to spin a heavy weight and small electric motors such as motor 1030 depicted in FIG. 1 together with first and second engineering drawings 1040 and 1050 do not like to efficiently produce high levels of torque in the desired frequency range.

Due to the constraints listed above the prior art within the adult device industry is for vibration motors to be designed to spin at the same speed as the off center weight by attaching the weight directly to the motor drive shaft. The weights are normally the same outside diameter as the motor in order to produce the maximum vibration force. Accordingly, as designers want as much vibration power as possible, the motor and weight outside diameter are typically the same or slightly smaller than the inner diameter of the inside of the adult device allowing the motor diameter to be made as large as possible within the constraints of the adult device and produce as much torque as possible.

However, smaller higher efficiency motors in order to produce large amounts of power must be operated such that they are running at, typically, 10,000 RPM$\leq f_{ROTATION} \leq$30,000 RPM which is outside the range of the desired vibration. In order to produce a vibration frequency in 2,000 RPM$\leq v_{VIBRATION} \leq$7,000 RPM from a motor operating at 10,000 RPM$\leq f_{ROTATION} \leq$30,000 RPM then the inventors exploit gearing in order to allow the same motor to produce more power by operating at increased RPM while still providing vibration at the pleasurable lower frequency(ies). Accordingly, the inventor has established designs allowing for the appropriate gearing to allow heavy weights to be spun with small diameter and high efficiency whilst removing the limitation that the gear reduction lead to an increase in the outside diameter of the adult device. As adult devices have very limited space for the motor and weight system, adult devices cannot be made larger from a practical use point of view, and gear reduction increases the outside diameter of the vibration motor system, adult devices within the prior art do not use gear reduction.

Accordingly, in order to overcome this design limitation the inventor has established devices which beneficially provide users with adult devices providing high impact (amplitude) vibration in a range of physical geometries compatible with providing internal and/or external stimulation to the user. Further, these devices can offered at low cost and/or low manufacturing cost with extended operating life. Accordingly, the inventor has beneficially established axial designs, non-axial designs, flexible drive designs, aperiodic drive designs, and linearly driven designs to provide a range of design solutions to designers for implementing vibrators with low cost, high impact, targeted frequency characteristics, increased efficiency, and increased power.

Other aspects and features of the present invention will become apparent to those ordinarily skilled in the art upon review of the following description of specific embodiments of the invention in conjunction with the accompanying figures.

SUMMARY OF THE INVENTION

It is an object of the present invention to mitigate limitations within the prior art relating to devices for sexual pleasure and more particularly to adult devices providing higher amplitude vibrations, aperiodic stimulation, and exploiting high speed motors for reduced cost.

In accordance with an embodiment of the invention there is provided a device comprising:

a motor providing rotary motion;

a flexible drive shaft coupled to a drive wheel;

a radial element coupled to the drive wheel through mechanical contact converting the rotary motion of the drive wheel under action of the motor at a first predetermined rotation rate to rotatory motion at a second predetermined rotation rate; and an asymmetric annular weight coupled to the radial element providing vibratory action when rotated at the second predetermined rotation rate.

In accordance with an embodiment of the invention there is provided an adult device for sexual stimulation providing vibratory motion within a first predetermined frequency range comprising a motor operating at a second predetermined frequency range substantially higher than the first predetermined frequency range disposed within a first portion of the adult device and a reduction assembly and asymmetric rotatable weight within a second portion of the adult device wherein the first and second portions may be offset relative to one another due to the use of a flexible drive shaft from the motor to the reduction assembly.

In accordance with an embodiment of the invention there is provided a device for sexual stimulation comprising:

a motor;

a reduction assembly coupled to the motor via a drive shaft for reducing the output rotation rate of the motor by a predetermined ratio; and an asymmetric rotating weight coupled to the reduction assembly to impart motion to a predetermined portion of the device and thereby a user's body when the device is in contact with the user's body.

In accordance with an embodiment of the invention there is provided an adult device for sexual stimulation comprising:

a motor operating within a first predetermined frequency range;

a series of reduction stages, each reduction stage coupled via an input shaft to a preceding member in the series and comprising an output shaft have a rotation rate reduced by a predetermined factor from that of its associated input shaft and the first stage in the series of reduction stages being coupled to a shaft of the motor; and at least one of an asymmetric weight coupled to either the last reduction stage directly or the output shaft of the last reduction stage for imparting vibration to a predetermined region of an outer surface of the device at the rotation rate of the last reduction stage;

an asymmetric weight coupled to either a reduction stage directly or the output shaft of the reduction stage for imparting vibration to a predetermined region of an outer surface of the device at the rotation rate of the reduction stage; and an element coupled to either a reduction stage directly or the output shaft of the reduction stage for imparting a sensation to a user of the device via a predetermined region of an outer surface of the device at the rotation rate of the reduction stage.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

Embodiments of the present invention will now be described, by way of example only, with reference to the attached Figures, wherein.

DETAILED DESCRIPTION

Figure 1:
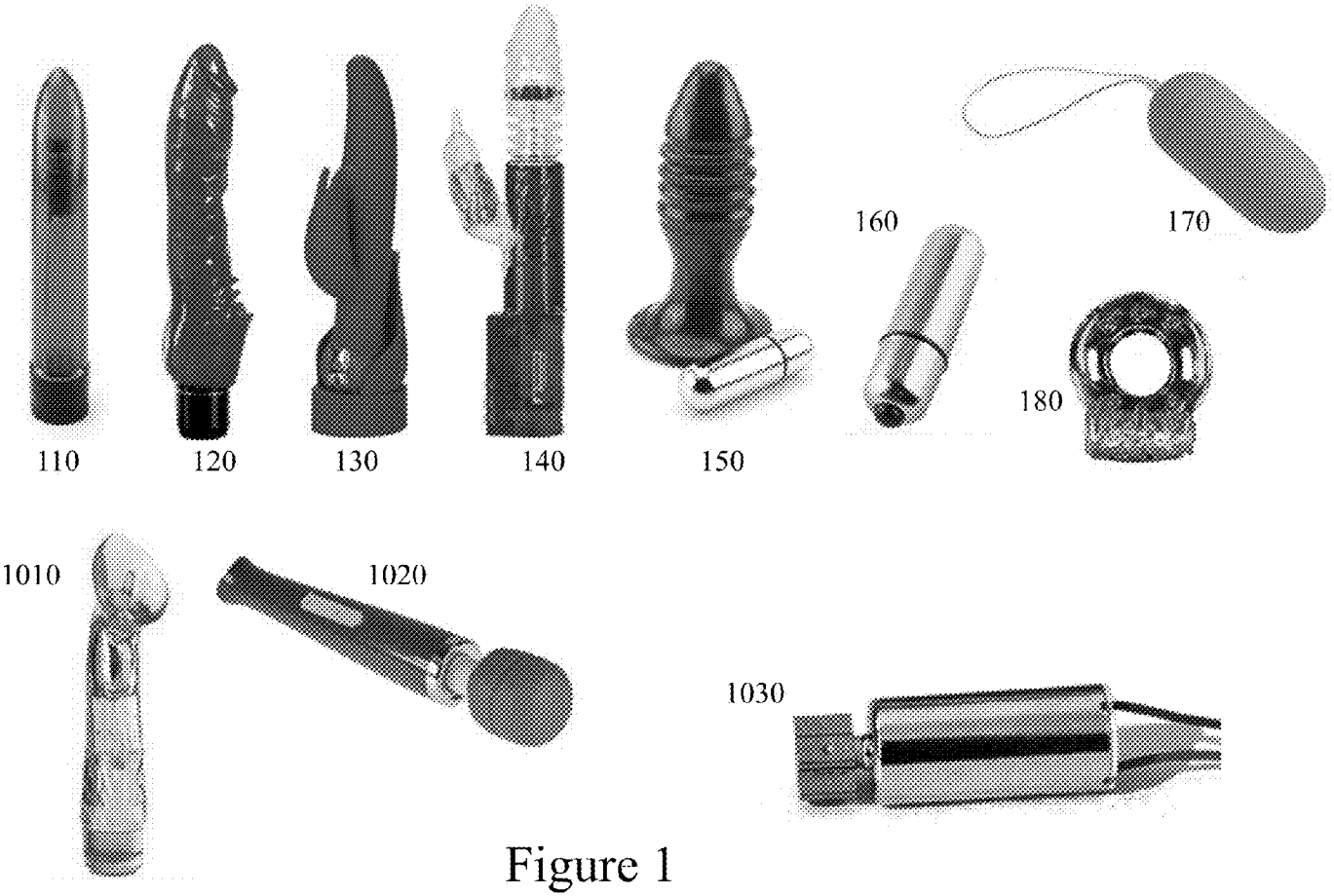
FIG. 1 depicts a range of prior art active adult devices together with prior art vibratory motor.

The present invention is directed to devices for sexual pleasure and more particularly to adult devices providing higher amplitude vibrations, aperiodic stimulation, and exploiting high speed motors for reduced cost whilst operating at desirable low frequencies with increased power and efficiency without increasing overall device diameter.

The ensuing description provides representative embodiment(s) only, and is not intended to limit the scope, applicability or configuration of the disclosure. Rather, the ensuing description of the embodiment(s) will provide those skilled in the art with an enabling description for implementing an embodiment or embodiments of the invention. It being understood that various changes can be made in the function and arrangement of elements without departing from the spirit and scope as set forth in the appended claims. Accordingly, an embodiment is an example or implementation of the inventions and not the sole implementation. Various appearances of "one embodiment," "an embodiment" or "some embodiments" do not necessarily all refer to the same embodiments. Although various features of the invention may be described in the context of a single embodiment, the features may also be provided separately or in any suitable combination. Conversely, although the invention may be described herein in the context of separate embodiments for clarity, the invention can also be implemented in a single embodiment or any combination of embodiments. It would also be evident that an embodiment may refer to a method or methods of manufacturing a device for sexual pleasure rather than the actual design of a device for sexual pleasure and that vice-versa an embodiment of the invention may refer to a device or devices rather than the method or methods of manufacturing.

Reference in the specification to "one embodiment", "an embodiment", "some embodiments" or "other embodiments" means that a particular feature, structure, or characteristic described in connection with the embodiments is included in at least one embodiment, but not necessarily all embodiments, of the inventions. The phraseology and terminology employed herein is not to be construed as limiting but is for descriptive purpose only. It is to be understood that where the claims or specification refer to "a" or "an" element, such reference is not to be construed as there being only one of that element. It is to be understood that where the specification states that a component feature, structure, method, or characteristic "may", "might", "can" or "could" be included, that particular component, feature, structure, or characteristic is not required to be included. It would also be evident that an embodiment and/or the phraseology and/or terminology may refer to a method or methods of manufacturing a device for sexual pleasure rather than the actual design of a device for sexual pleasure and that vice-versa an embodiment and/or the phraseology and/or terminology may refer to a device or devices rather than the method or methods of manufacturing.

Reference to terms such as "left", "right", "top", "bottom", "front" and "back" are intended for use in respect to the orientation of the particular feature, structure, or element within the figures depicting embodiments of the invention. It would be evident that such directional terminology with respect to the actual use of a device has no specific meaning as the device can be employed in a multiplicity of orientations by the user or users.

Reference to terms "including", "comprising", "consisting" and grammatical variants thereof do not preclude the addition of one or more components, features, steps, integers or groups thereof and that the terms are not to be construed as specifying components, features, steps or integers. Likewise the phrase "consisting essentially of", and grammatical variants thereof, when used herein is not to be construed as excluding additional components, steps, features integers or groups thereof but rather that the additional features, integers, steps, methods, components or groups thereof do not materially alter the basic and novel characteristics of the claimed composition, device or method. If the specification or claims refer to "an additional" element, that does not preclude there being more than one of the additional element or method.

A "user" as used herein, and throughout this disclosure, refers to an individual engaging a device according to embodiments of the invention wherein the engagement is a result of their personal use of the device or having another individual using the device upon them.

A "vibrator" as used herein, and throughout this disclosure, refers to an electronic sexual pleasure device intended for use by an individual or user themselves or in conjunction with activities with another individual or user wherein the vibrator provides a vibratory mechanical function for stimulating nerves or triggering physical sensations.

A "dildo" as used herein, and throughout this disclosure, refers to a sexual pleasure device intended for use by an individual or user themselves or in conjunction with activities with another individual or user wherein the dildo provides non-vibratory mechanical function for stimulating nerves or triggering physical sensations.

An "adult device", "sex toy" or "sexual pleasure device" as used herein, and throughout this disclosure, refers to a sexual pleasure device intended for use by an individual or user themselves or in conjunction with activities with another individual or user which can provide one or more functions including, but not limited to, those of a dildo and a vibrator. The sexual pleasure device/toy can be designed to have these functions in combination with design features that are intended to be penetrative or non-penetrative and provide vibratory and non-vibratory mechanical functions. Such sexual pleasure devices can be designed for use with one or more regions of the male and female bodies including but not limited to, the clitoris, the clitoral area (which is the area surrounding and including the clitoris), vagina, rectum, nipples, breasts, penis, testicles, prostate, and "G-spot." In one example a "male sexual pleasure device" is a sexual pleasure device configured to receive a user's penis within a cavity or recess. In another example, a "female sexual pleasure device" is a sexual pleasure device having at least a portion configured to be inserted in a user's vagina or rectum. It should be understood that the user of a female sexual pleasure device can be a male or a female when it is used for insertion in a user's rectum.

Texture as used herein, and throughout this disclosure, refers to a feel of a surface of a device and is generally described and/or defined in terms of smoothness, roughness, hardness, softness, waviness, and form. Such texturing may adjust the feeling of the device in respect of contact to a user and may control and/or adjust friction between the device and human skin/tissue. Surface texture may be isotropic or anisotropic. Textures may be, but not limited to, smooth, rough, ridged, dumped, grainy, and may refer to the visual and/or tactile qualities of the surface.

A "nubby" or "nubbies" as used herein, and throughout this disclosure, refers to a projection or projections upon the surface of a sexual pleasure device intended to provide additional physical interaction. A nubby can be permanently part of the sexual pleasure device or it can be replaceable or interchangeable to provide additional variation to the sexual pleasure device.

An "accessory" or "accessories" as used herein, and throughout this disclosure, refers to one or more objects that can be affixed to or otherwise appended to the body of a sexual pleasure device in order to enhance and/or adjust the sensation(s) provided. Such accessories can be passive, such as nubbies or a dildo, or active, such as a vibrator.

Within embodiments of the invention described below in respect of FIGS. 2 to 14 elements such as gears, shafts, etc. are depicted and described in respect of rotary gearing and drive systems. For clarity in drawings and description ancillary elements such as bearings, shafts, couplings, mountings, etc. may not be depicted/described but would be evident to one skilled in the art.

Female users of adult devices generally request a high amplitude, deep rumble type of vibration rather than the high pitched vibration from prior art vibrators. Generating a low frequency vibration requires that the weights be maximized which coupled with considering the target speed range (RPM) of the motor means making the weight longer, higher density, and/or larger diameter. However, using metals with densities higher than tungsten, a commonly used high density material, is generally too expensive. At the same time as noted supra weights cannot get larger in diameter without increasing the diameter of the toy which is difficult given human physiology and user preferences. As a consequence research and development for adult devices has ended to focus on small motors and improving their starting torque, in order to get the large weight moving initially, and performance over the desired vibration frequency range 2,000 RPM$\leq v_{VIBRATION} \leq$7,000 RPM, such that the off center weights have gotten longer.

Concurrently as vibration weights have got longer and heavier then the motor shaft diameter has had to increase in order to prevent the weight from bending the shaft if the device is accidentally impacted or dropped. Some manufacturers have put a support bushing on the far side of the weight so that the motor shaft is not solely relied upon to support the weight during impact in order to have the desired large weight without increasing the motor shaft diameter. Other manufacturers exploit designs with shafts on both ends of the motor and half-length weights on each end in order to also remove the need for a larger motor shaft or for a separate weight support bushing. As evident from embodiments of the invention the motor shaft does not require increasing in diameter as the weight may be mounted on one or two bushings and through the use of flexible drive shafts is isolated from the weight.

The ability of small motors to start spinning is significantly impaired with large weights coupled to their drive shafts. Although designers can install large weights and support them with an additional bushing, a motor with its weight attached directly to the motor shaft, as with prior art vibrators, still reaches a limit as to how large a weight a motor can actually start spinning Although a motor may have enough power when spinning at 5,000 RPM to spin a large weight, it is generally the ability of the motor to produce enough torque at 0 RPM to actually start the weight spinning that limits the weight. Embodiments of the invention address this by reducing the motor's required starting torque by the same ratio as the gear reduction applied to reduce its output when driving the weight. Accordingly, a 4:1 reduction in order to achieve a 5,000 RPM mechanical weight vibration with a motor operating at 20,000 RPM also means that the starting torque at 0 RPM is reduced to 25% of a prior art design. It would be evident, that as described below in respect of embodiments of the invention, that a wide range of reduction ratios may be provided through single stage and multi-stage reduction drives.

Because motor torque is not significantly reduced with higher RPM, the power output of a motor at 20,000 RPM can be close to 4 times the power it will put out at 5,000 RPM. Accordingly, embodiments of the invention allow more than a doubling of the vibration energy to be generated within the same diameter adult device and still vibrate within the 2,000 RPM$\leq v_{VIBRATION} \leq$7,000 RPM as well as supporting mechanical actions at much lower RPM. Beneficially embodiments of the invention allow for a larger weight to be started spinning by the motor by reducing the required torque when the motor tries to spin up from 0 RPM. Such larger weights may be derived from density, length, radius, or a combination thereof.

Further, as electrical motor efficiency improves with higher RPM, and accordingly, motors employed within embodiments of the invention may produce significantly more vibration power yet not consume more electrical power. Accordingly, the user of an adult device may experience improved vibration for the same length of time as with a prior art vibrator and not require a larger battery or replacement battery. As noted supra small DC motors operate best at high RPM, 10,000 RPM$\leq f_{ROTATION} \leq$30,000 RPM, for highest efficiency and accordingly, prior art adult device motors sacrifice efficiency in order to achieve the 2,000 RPM$\leq v_{VIBRATION} \leq$7,000 RPM vibration frequency range people enjoy. Operating in this frequency range can reduce a motor's efficiency by 50% or more.

The vibration "g-force", or centrifugal force F, is equal to the mass being rotated multiplied by the square of the angular velocity multiplied by the radius of the rotating mass. Accordingly, the length of the weight acts to linearly increase the mass. However, if the density of the weight increases then the same mass can be made with an increased radius, essentially it's "center of mass radius." and it increases linearly with the length of the weight. Accordingly, for low cost weights of a single material the adult device designer can only increase the length of the weight within a fixed diameter adult device to increase effective vibrational force. However, exploiting materials of increased density and reduced dimensions can provide the same equivalent mass but with an increased effective centre of mass radius.

Figure 2:
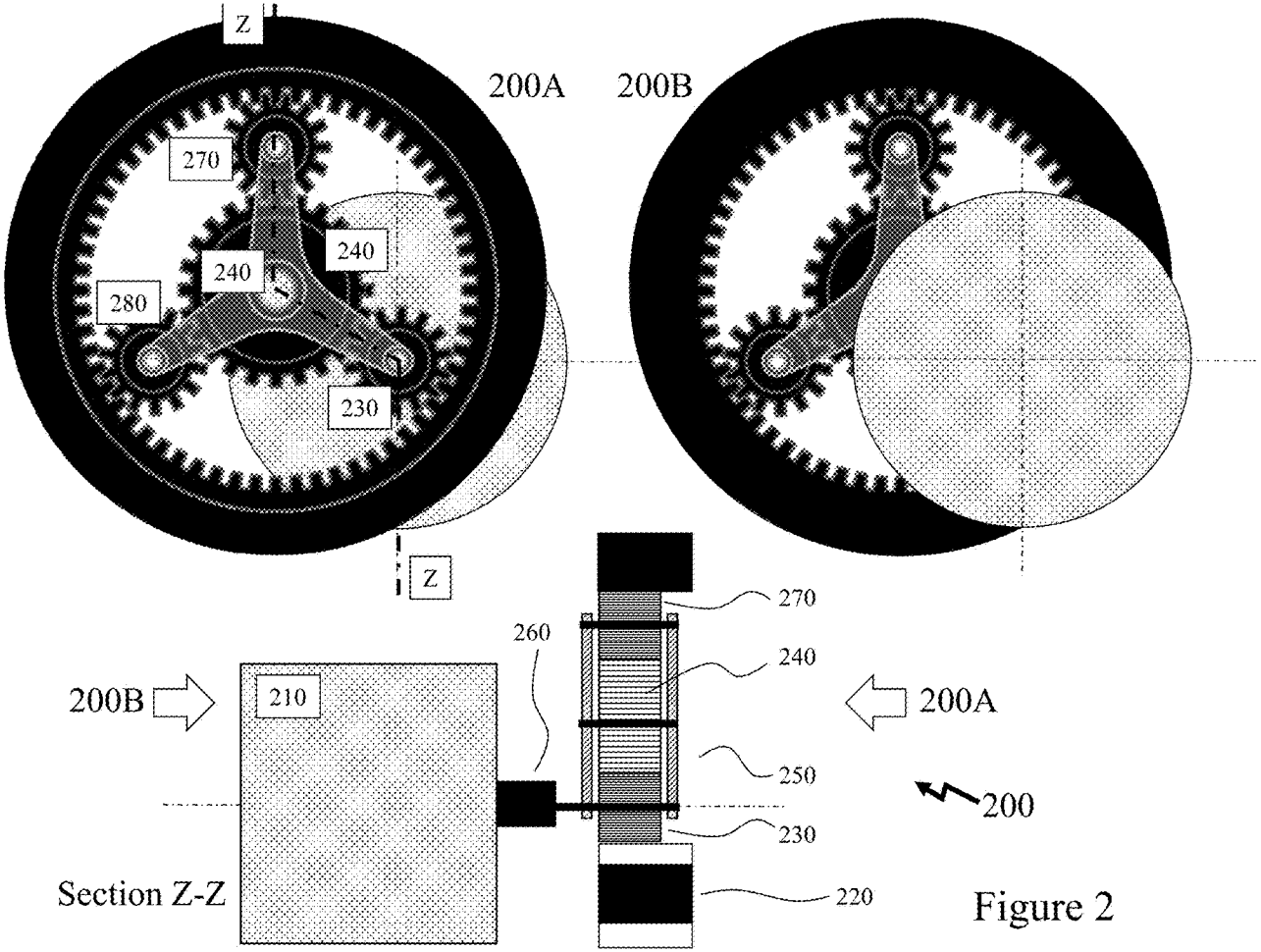
FIG. 2 depicts a vibratory motor according to an embodiment of the invention.

FIG. 2 depicts a vibratory motor 200 according to an embodiment of the invention in cross-section Z-Z together with first and second end-views 200A and 200B respectively. As depicted a motor 210 is coupled via drive shaft 260 to a first gear 230 and therein to second gear 240 and third gear 270 which are also mounted to frame 250 via shafts allowing rotation of the second and third gears 240 and 270. Coupled to the outer surfaces of second and third gears 240 and 270 is ring gear 220 which comprises an annular body with inner gear teeth compared to the external gear teeth on first to third gears 230, 240 and 270. As evident in first end-view 200A a fourth gear 280 is also disposed within the vibratory motor 200 between the second gear 240 and ring gear 220. Accordingly, rotation of the first gear 230 via the action of the motor 210 results in counter-rotation of the second gear 240 and rotation of the ring gear 220. Second gear 240 then drives third and fourth gears 270 and 280 which in turn engage with the ring gear 220.

If the motor 210 were attached to an outer body surrounding the vibratory motor 200 then the ring gear 220 would rotate within the outer body. Accordingly, the ring gear 220 may itself directly or through attachments, be asymmetric in weight distribution such that rotation of the ring gear 220 results in vibration of the vibratory motor 200 within the housing it is disposed. It would be evident that first to fourth gears 230, 240, 270, and 280 engage and drive ring gear 220 as well as providing mechanical integrity for the assembly with the frame(s) 250.

With respect to the ratio of such a vibratory motion in respect of ring gear 220 relative to motor 210 then let R be the number of teeth in ring gear 220, S be the number of teeth in second gear 240, and P be the number of teeth on first, third and fourth gears 230, 270, and 280. Further, a design constraint is that all teeth on first to fourth gears 230, 240, 270, and 280 have the same pitch, or tooth spacing to ensure that the gear teeth mesh. The second design constraint is that R=2×P+S, i.e. the number of teeth in the ring gear is equal to the number of teeth in the middle sun gear plus twice the number of teeth in the planet gears. If we now let $T_R$ represent turns of the ring gear 220, $T_S$ represent turns of the second gear 240, and $T_Y$ represent turns of the first gear 220 then we establish Equation (1) below. Accordingly, it would be evident that each turn of first gear 240 drives ring gear 220 as given by Equation (1) and hence the vibratory motor 200 has a reduction gear of ratio R/P. For example, if [R=12; S=18; P=42] then the reduction ratio is 12/42. Accordingly, a compact high speed motor 210 may be employed to drive the vibratory motor 200 such that the high efficiency high power high speed motor is reduced through the gearing to provide the lower frequency vibrations for a given diameter. It would be evident that a range of other gear ratios may be provided according to the characteristics of the motor, adult device, etc.

Figure 3A:
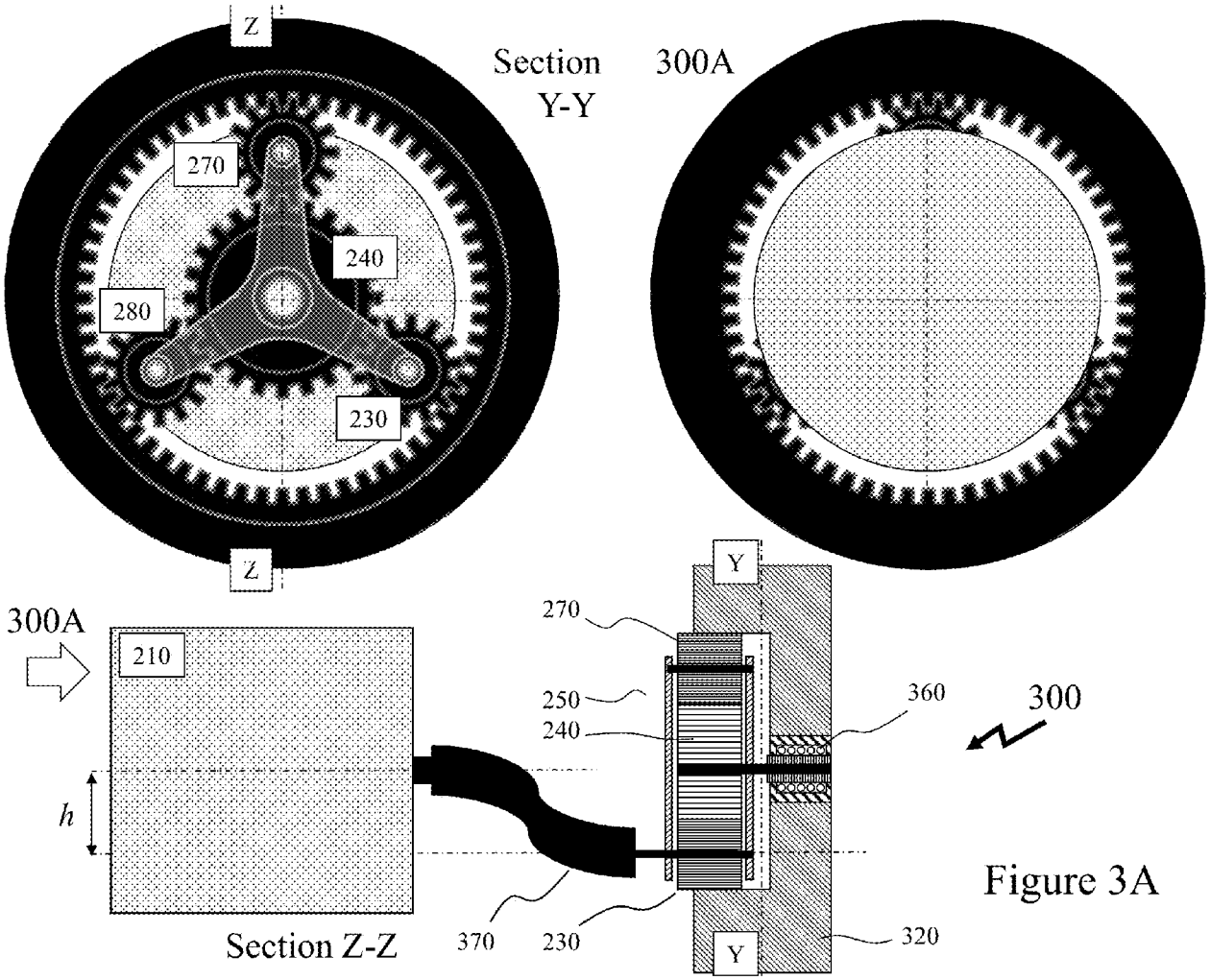
FIG. 3A depicts a vibratory motor according to an embodiment of the invention exploiting a flexible drive shaft.

It would be evident that the diameter of vibratory motor 200 is larger than the motor 210 which within the description supra which may limit the use of high speed high efficiency high power motors to provide the desired vibratory function in the target frequency range. However, as depicted in FIG. 3A an alternate configuration with a vibratory motor 300 according to an embodiment of the invention in cross-sections Y-Y and Z-Z together with first end-view 300A. As depicted a motor 210 is coupled via flexible drive shaft 360 to a first gear 230 and therein to second gear 240 and third gear 270 which are also mounted to frame 250 via shafts allowing rotation of the second and third gears 240 and 270. Coupled to the outer surfaces of second and third gears 240 and 270 is ring gear 320 which comprises an annular body with inner gear teeth compared to the external gear teeth on first to third gears 230, 240 and 270. As evident in first end-view 200A a fourth gear 280 is also disposed within the vibratory motor 200 between the second gear 240 and ring gear 320. Accordingly, rotation of the first gear 230 via the action of the motor 210 results in counter-rotation of the second gear 240 and rotation of the ring gear 320. Second gear 240 then drives third and fourth gears 270 and 280 which in turn engage with the ring gear 320.

Additionally, the ring gear 320 is restrained longitudinally through bearing 360 which mounts to a central shaft coupled to second gear 240. Accordingly, if the motor 210 and frame were physically restrained with respect to an outer body surrounding the vibratory motor 300 then the ring gear 320 would rotate within the outer body. Accordingly, the ring gear 320 may itself directly or through attachments, be asymmetric in weight distribution such that rotation of the ring gear 320 results in vibration of the vibratory motor 300 within the housing it is disposed. It would be evident that first to fourth gears 230, 240, 270, and 280 engage and drive ring gear 320 as well as providing mechanical integrity for the assembly with the frame(s) 250. In contrast to vibratory motor 200 in FIG. 2 the vibratory motor 300 now has the centre of axis of the motor 210 the same as the axis of rotation of the weight within/upon ring gear 320 as the rotary action of the motor 210 is coupled to the first gear 230 via a flexible drive shaft 360 that allows for the lateral offset in the motor and gear axis, h.

Optionally, the ring gear 320 may also be mounted via a second bearing on the other side, not shown for clarity, according to the mechanical/physical requirements and/or limitations of the vibratory motor 300 and the adult device it fits within or allowing for higher weight asymmetry to be managed, device lifetime increased, etc. Optionally, other bearings may be provided such as in association with one or more of the first gear 230, second gear 240, third gear 270, and fourth gear 280. For example, a bearing/mount for the drive shaft coupled to the first gear 230 from the flexible drive shaft 370 may be employed reducing axial strain on the drive shaft coupled to the first gear 230.

Flexible drive shaft 370 may be formed from a variety of materials including, but not limited, silicone, rubber, flexible plastics, and metal according to the overall torque, power, RPM, load, etc. Flexible drive shafts may be formed by a variety of designs including a single solid shaft, a plurality of layered tensile wires without a hollow core, or a plurality of layered tensile wires with a hollow core, for example. Attachment of the flexible drive shaft to the shaft of a motor and/or gear may be provided through an interference fit, clamping, welding, soldering, gluing, and other techniques known within the art. Tensile wire designs may exploit low carbon spring steel, medium carbon spring steel, high carbon music wire, high carbon rocket wire, stainless steel (e.g. Class 1 Hard), stainless steel spring tempered, low carbon stainless steel, nickel titanium (nitinol, e.g. Nitinol 55, Nitinol 60, etc.), Nitronic 50 spring tempered, spring tempered phosphor bronze, Inconel nickel alloy, Monel nickel copper alloy, copper alloy, Kevlar™, silicone, axially fiber reinforced silicone, as well as other metals, plastics, high strength nanofibers etc.

Figure 3B:
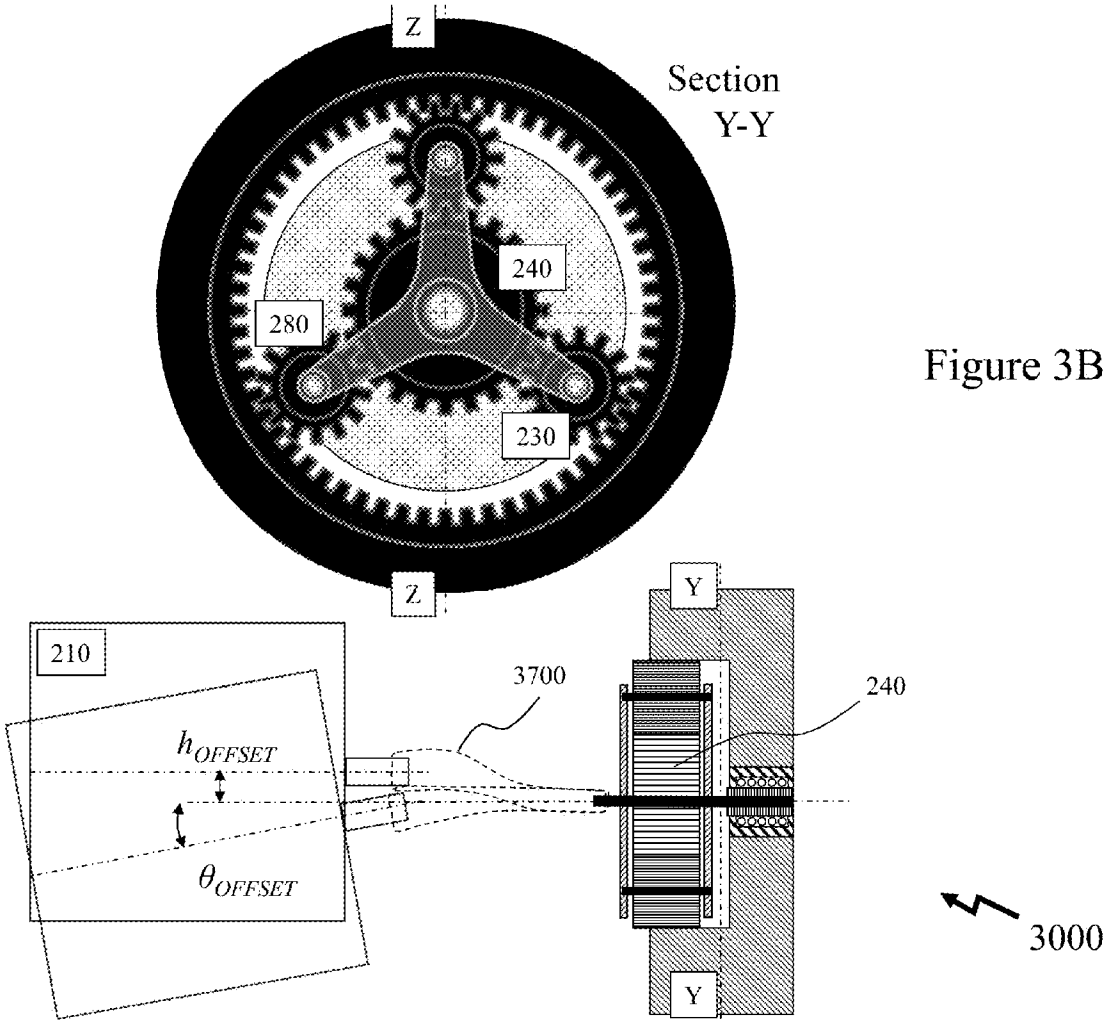
FIG. 3B depicts a vibratory motor according to an embodiment of the invention exploiting a flexible drive shaft.

Referring to FIG. 3B an alternate design is depicted wherein the motor 210 is coupled to the second gear 240 via flexible drive shaft 3700 wherein the flexible drive shaft 3700 allows for rotational and axial offset between a first portion of the adult device housing the motor and a second portion of the adult device housing the gear train and ring gear with off-axis weight.

Figure 4:
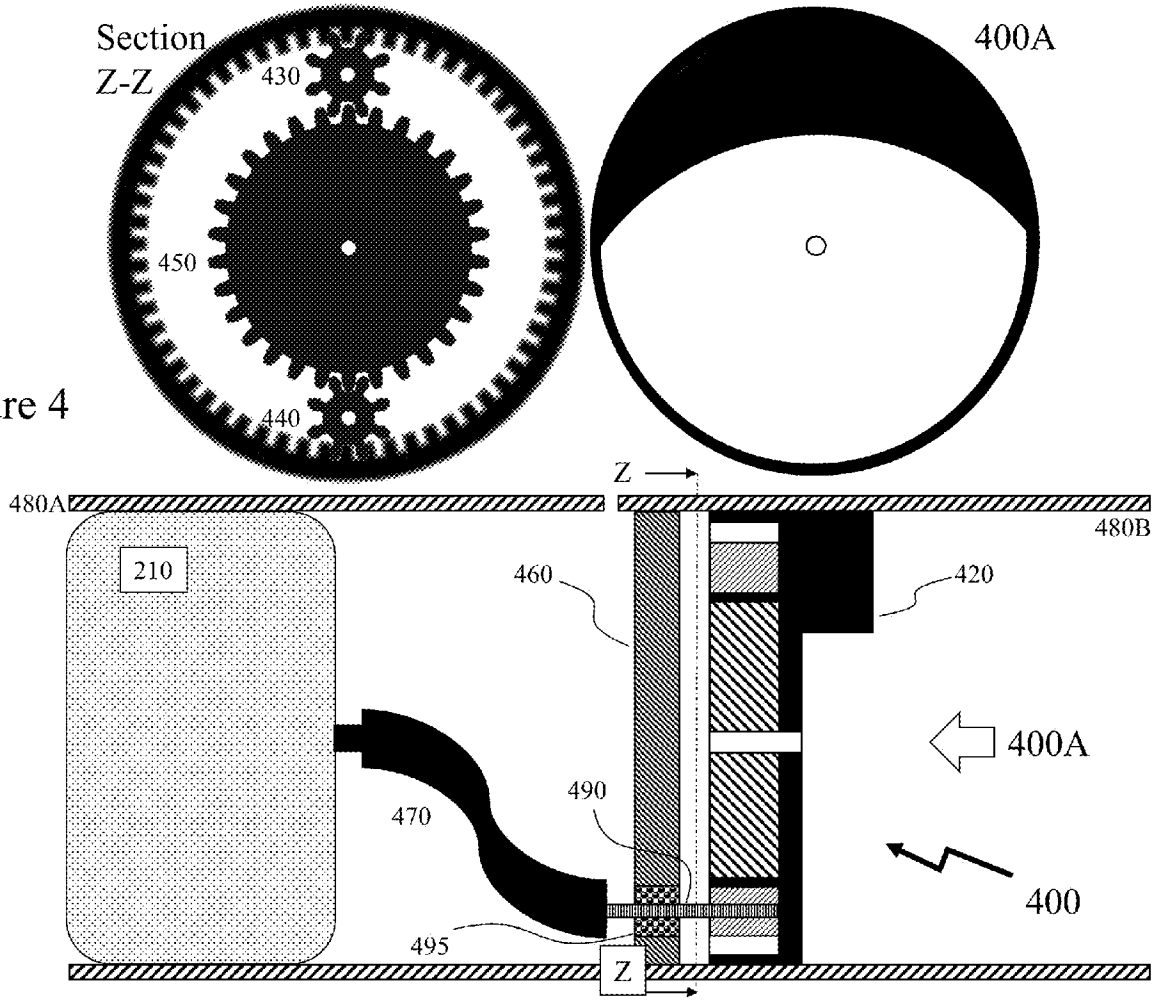
FIG. 4 depicts a vibratory motor according to an embodiment of the invention exploiting a flexible drive shaft.

FIG. 4 depicts a vibratory motor 400 according to an embodiment of the invention exploiting a flexible drive shaft 470 in combination with a motor 210 within a housing elements 480A and 480B. As depicted the motor 210 is connected to shaft 490 within bearing 495, the other end of shaft 490 being coupled to first gear 440. Bearing 485 being disposed within wall 460 forming part of the adult device together with housing elements 480A and 480B. Housing elements 480A and 480B may be part of the same element of an adult device, e.g. outer shell, or they may be separate portions joined in some manner such that motion of the housing element 480B relative to the housing element 480A may occur. Such relative movement being accommodated by the flexible driver shaft 470. For example, a larger motor may be within a base of an adult device driving a vibrating element within another portion of the adult device wherein the adult device may be deformed to suit the user's physiology.

As depicted in cross-section Z-Z the first gear 440 driven by the shaft 490 couples to second gear 450 and therein third gear 430 which is equivalent to first gear 440 in terms of teeth, tooth pitch, diameter etc. Accordingly, first and third gears 440 and 430 drive the ring gear 420, which has disposed radially an asymmetric weight distribution leading to vibration during operation. Alternatively, the motor 210 may be coupled via a flexible drive shaft, bearing, and drive shaft to second gear 450 which is reduced in size/teeth and couples to larger first and third gears 440 and 430 respectively.

Figure 5:
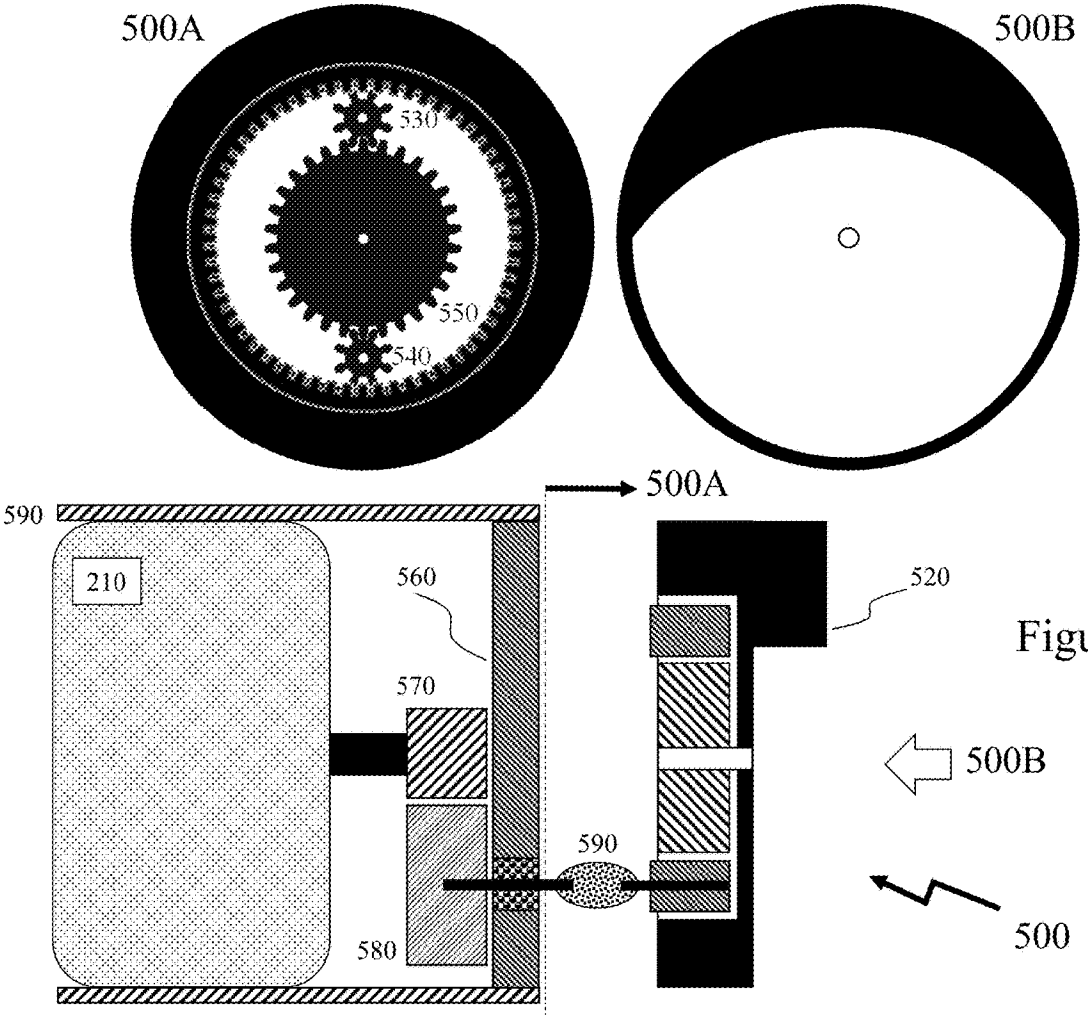
FIG. 5 depicts a vibratory motor according to an embodiment of the invention.

Now referring to FIG. 5 there is depicted a vibratory motor 500 according to an embodiment of the invention together with cross-section 500A and end view 500B. As depicted the motor 210 is connected to a first gear 570 and therein second gear 580 before is coupled via flexible shaft 590 to third gear 540. As depicted in cross-section 500A the third gear 540 driven by the flexible shaft 590 couples to fourth gear 550 and therein fifth gear 530 which is equivalent to third gear 540 in terms of teeth, tooth pitch, diameter etc. Accordingly, fifth and third gears 540 and 530 drive the ring gear 520, which has disposed radially an asymmetric weight distribution leading to vibration during operation. Alternatively, the motor 210 may be coupled via the flexible shaft, bearing, and drive shaft to fourth gear 550 which is reduced in size/teeth and couples to larger fifth and third gears 540 and 530 respectively. Accordingly, the output of motor 210 is initially reduced by a first gear reduction stage comprising first and second gears 570 and 580 respectively before being reduced by a second gear reduction stage comprising third to fifth gears 540, 550, and 530 and ring gear 520. As depicted in end view 500B the ring gear 520 has asymmetric weight distribution.

Figure 6:
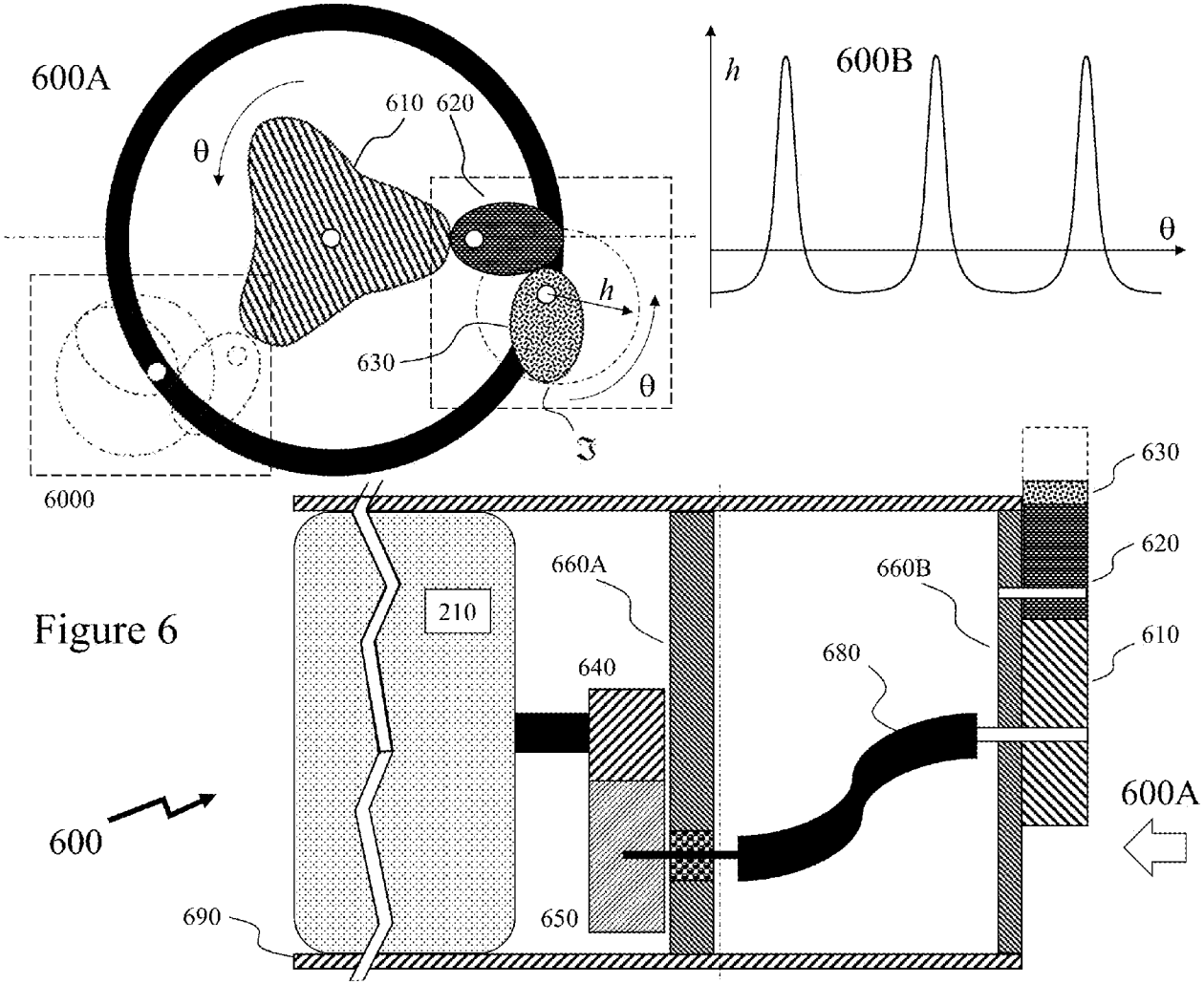
FIG. 6 depicts a vibratory motor according to an embodiment of the invention exploiting a flexible drive shaft.

Referring to FIG. 6 there is depicted a vibratory motor 600 according to an embodiment of the invention exploiting a flexible drive shaft 680 together with insert 600B and end view 600A. As depicted motor 210 is connected to a first gear 640 and therein second gear 650 within body 690 before is coupled via flexible shaft 680 to third gear 610 through a bearing within first member 660A. As depicted in cross-section 500A the third gear 610 driven by the flexible shaft 680 couples to fourth gear 620 and therein fifth gear 630, all of which are mounted on second member 660B. However, as evident from end view 600A third gear 610 is an eccentric gear, depicted with three "spokes" which is coupled to fourth gear 620 and therein fifth gear 630, both of which are elliptical gears with mounting at one of their loci. Accordingly, as third gear 630 rotates it drives the fourth and fifth gears 620 and 630 respectively such that the overall displacement of the end of the fifth gear 630, denoted by $\Im$, radially from the mounting point follows a trajectory such as depicted in insert 600B.

As evident in insert 600B this displacement is periodic, with a frequency determined by the number of "spokes" of third gear 610 but highly asymmetric in that for the majority of time the point $\Im$ is closer to the axis of the third gear 610 and moving slowly but has rapid positive displacements such that if the point $\Im$ impacted an outer surface of the adult device comprising the vibratory motor 600 then the user would sense high intensity "thumps" rather than vibration. As evident with assembly 6000 additional assemblies of fourth and fifth gears 620 and 630 respectively may be disposed around the periphery of the vibratory motor 600. Whilst assembly 6000 is depicted disposed at another "spoke" of the third gear 610 it would be evident that optionally additional assemblies 6000 may be disposed in a particular region such that the user senses a moving series of "thumps."

Figure 7:
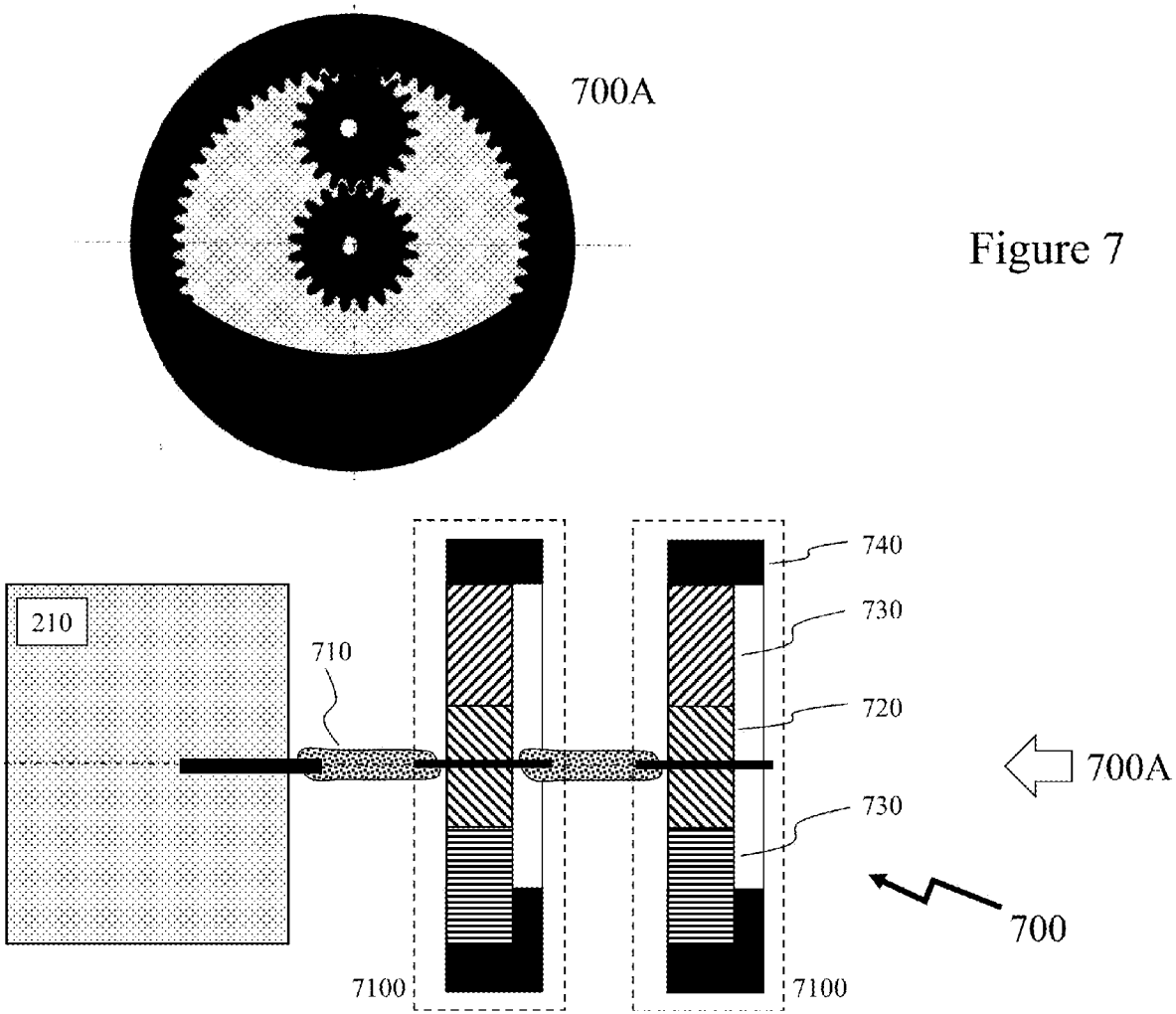
FIG. 7 depicts a vibratory motor according to an embodiment of the invention.

Now referring to FIG. 7 there is depicted a vibratory motor 700 according to an embodiment of the invention with flexible drives 710 coupling motor 210 and gear assemblies 7100. As depicted each gear assembly 7100 comprises a central gear 720 together with radial gears 730 which engage ring gear 740. Each ring gear 740 as depicted in end view 700A has an asymmetric weight distribution. Accordingly, it would be evident that a plurality of gear assemblies 7100 may be disposed within an adult device being driven from a single motor 210 but within an outer body that allows deflection/distortion as each gear assembly 7100 may move relative to the others and the motor 210. It would be evident that sequential gear assemblies 7100 may be of different designs, e.g. a gear assembly 7100 may exploit the eccentric periodic action of the gear assembly within vibratory motor 600 in FIG. 6.

Figure 8:
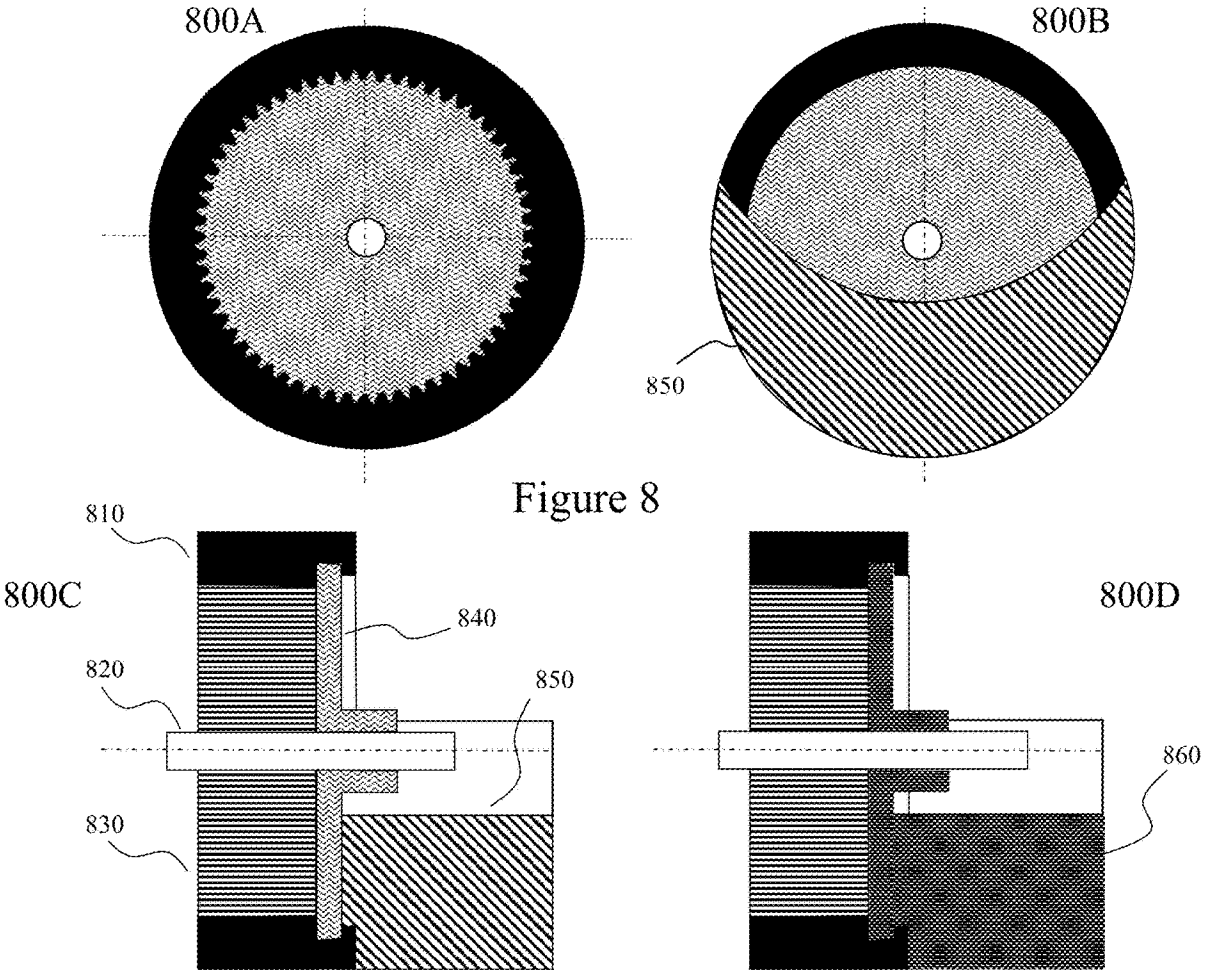
FIG. 8 depicts assembly of a weight system for a vibratory motor according to an embodiment of the invention.

FIG. 8 depicts assembly of a weight system for a vibratory motor according to an embodiment of the invention. As depicted in first and second views 800A and 800B a ring gear is depicted with gearing on the inner surface of one side of the outer ring of the ring gear and an asymmetric weight distribution on the other side. As depicted in first cross-section 800C such a ring gear may be formed through the combination of a ring 810 with teeth 830 which fits over shaft 820 and upon which member 840 slides and snap fits to the edge of the ring 810. The member 840 has mounted upon it weight 850. Accordingly, for example, a metal ring 810 may be employed with plastic member 840 and metallic weight 850 or alternatively the ring 810 and member 840 may be plastic with metal weight 850. Optionally, as depicted in second cross-section 800D the member and weight are a single piece-part 860.

Figure 9:
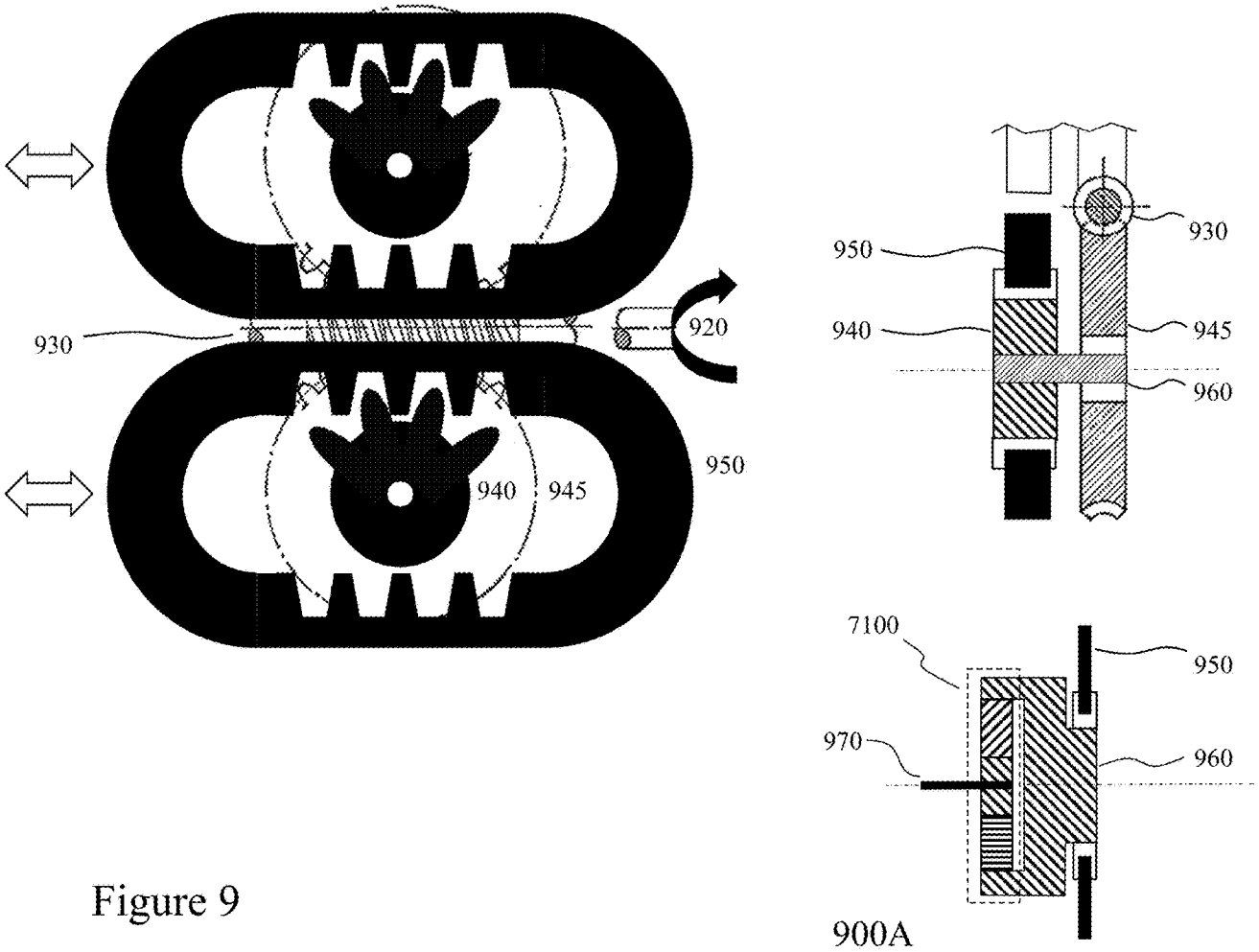
FIG. 9 depicts an impact inchworm driven motor according to an embodiment of the invention.

Referring to FIG. 9 there is depicted an impact inchworm driven motor 900 according to an embodiment of the invention. As depicted drive shaft 920 which is part of the same single element as inchworm 930 or alternatively coupled to it via a coupling and/or flexible drive shaft provides rotary drive to the inchworm from a motor, not shown for clarity. The inchworm 930 is coupled to drive gear 945 which itself coupled to impact gear 940 via interconnecting shaft 960. The impact gear 940 is coupled to impactor 950 wherein the linear teeth on the upper and lower inner linear sections of the impactor 950 engage with the impact gear 940 only when the teeth of the impact gear 940 are on the respective side of the impactor 950. As a result the motion of the impactor 950 is a periodic left/right from the rotary motion of the inchworm 930 driven from the motor 910.

It would be evident that impact gear 940 and drive gear 945 may be formed from a single piece-part and that the drive gear 945 is actually a ring gear of an embodiment of the invention described supra in respect of FIGS. 2-5 and 7-8 respectively. In this manner a high speed high efficiency motor may be coupled to a reduction gear assembly and an impactor such as depicted in FIG. 900A wherein the ring gear of a gear assembly 7100 is now single piece-part 960 incorporating also drive gear 945 and impact gear 940. Accordingly rotation of the drive shaft 970 results in later impact motion of impactor 950 although at a reduced frequency driven by the reduction gear. Optionally, multiple reduction gears may be employed sequentially for a substantial reduction in effective impact frequency from the motor or multiple impactors driven from a single reduction gear. Alternatively multiple reduction gears and impactors may be sequentially deployed providing a plurality of impact frequencies to the user at the same time rather than a single vibratory frequency as provided by a single reduction gear—impactor stage or prior art vibratory motors.

Within the embodiments of the invention description supra in respect of FIGS. 2 through 8 gears have been described as imparting a speed reduction from a compact high efficiency high speed motor to a ring gear with asymmetric weight distribution to provide vibrator functionality to the adult device comprising these elements. These gears may be formed from a variety of materials including, but not limited to, plastics, metal, ceramic, and fiber reinforced plastics according to factors including, but not limited to, the required dimensions, tolerances, volume, cost requirement etc. Manufacturing techniques may be similarly selected, in instances where multiple options exist, from those including, but not limited to, casting, molding, machining, and three-dimensional printing. Optionally, the gears may be replaced by wheels of rubber, silicone, or other materials providing a non-toothed outer perimeter but with sufficient friction to allow the transfer of rotary motion from themselves to one or more other elements. Optionally, one or more gears may be replaced by wheels, e.g. third and fourth gears 270 and 280 respectively in FIGS. 2 to 3B respectively, for example. Accordingly, positive gear drive is maintained but third and fourth gears 270 and 280 respectively which are essentially mechanical spacers are replaced by wheels. Optionally, these may also be low friction spacers mounted to these positions.

Figure 10:
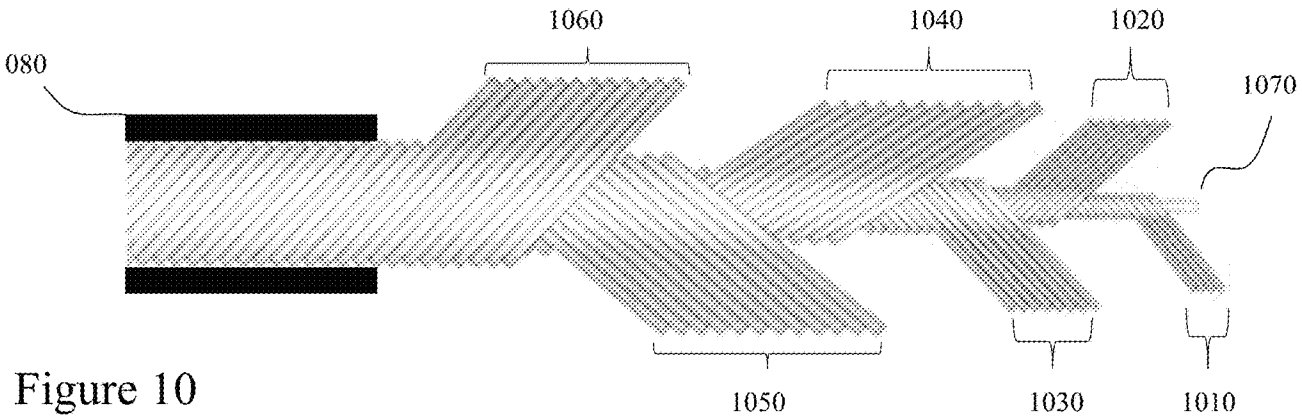
FIG. 10 depicts a flexible drive shaft construction according to an embodiment of the invention.

Referring to FIG. 10 there is depicted a flexible drive shaft according to an embodiment of the invention comprising a mandrel 1070 upon which six layers of filaments 1010 to 1060 are disposed wherein each of the six layers of filaments 1010 to 1060 comprises a number of individual filaments, e.g. first layer of filaments 1010 comprises four filaments whereas sixth layer of filaments 1060 comprises 12 filaments. The material, diameter, and properties of the filaments within each of the six layers of filaments 1010 to 1060 may be common or vary according to the design performance requirements of the flexible drive shaft including, but not limited to, length, maximum offset, rotational speed range, maximum torque, minimum torque, start-up torque, unidirectional or bidirectional operation, etc.

Figure 11:
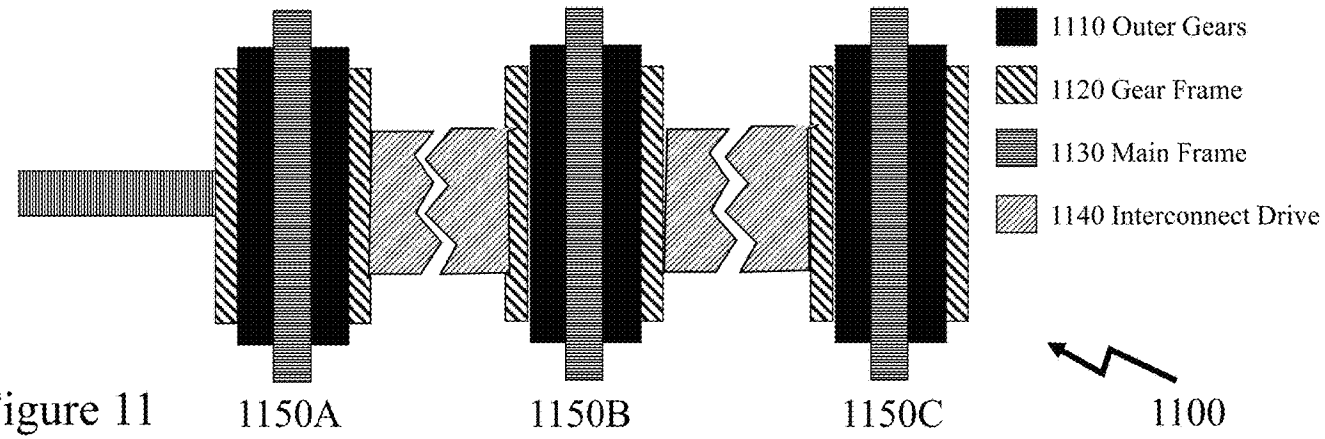
FIG. 11 depicts a cascading reduction sequence with multiple vibrating elements at different frequencies according to an embodiment of the invention.

FIG. 11 depicts a cascaded reduction gear employing flexible interconnect drives 1140 between stages 1150A to 1150C wherein each stage 1150A to 1150C comprises a central—outer gear design, similar to that depicted in FIG. 3A except for first stage 1150A the frame supporting the outer gears is not coupled to the central gear on either left or right hand side but the right hand side frame is connected to the flexible interconnect drive 1140 on the right hand side which is then coupled to the central gear of the next stage etc. In this manner if the first stage 1150A has a reduction of N then the net reduction of M stages is a reduction of $N^M$. Accordingly, even a low reduction per stage, e.g. 4 or 5, for 3 stages means a ×64 or ×125 reduction in speed and hence say a 12,000 rpm motor can be reduced to ~188 rpm and ~96 rpm respectively.

Figure 12A:
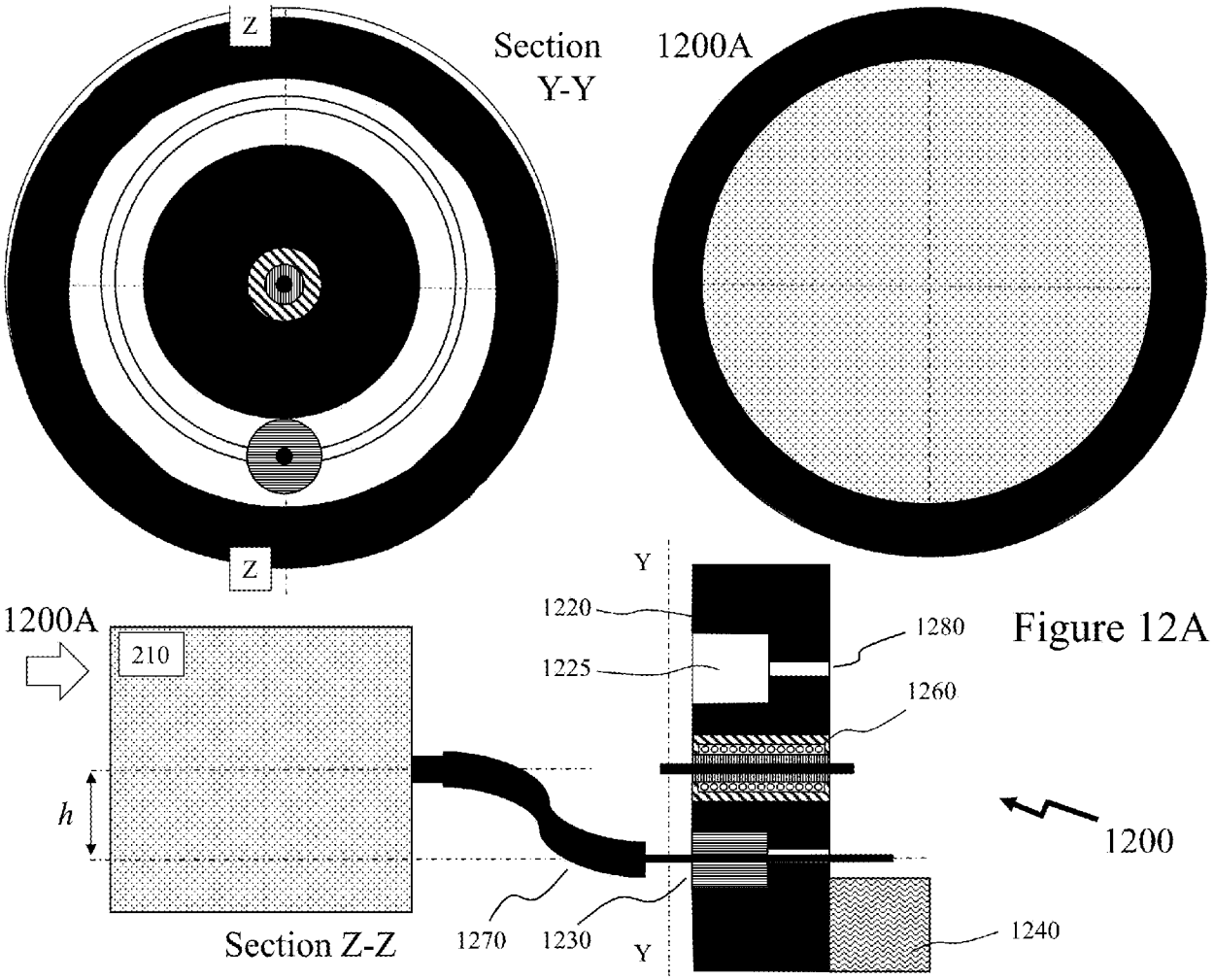
FIGS. 12A and 12B depict reduction drive mechanisms for vibrating motors according to an embodiment of the invention.
Figure 12B:
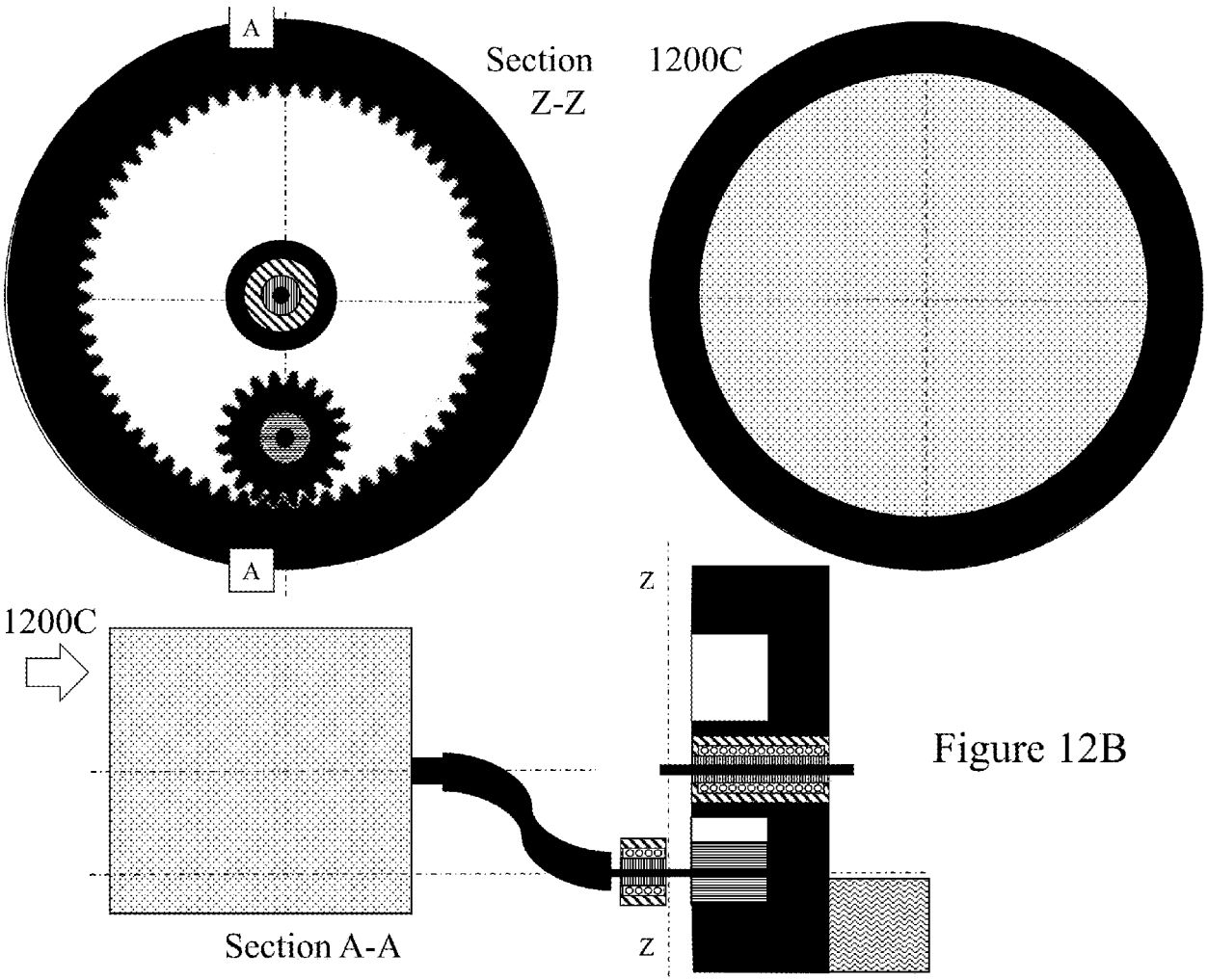

Now referring to FIG. 12A there is depicted a reduction drive in a vibrating motor 1200 according to an embodiment of the invention in cross-sections Y-Y and Z-Z together with first end-view 1200A. As depicted a motor 210 is coupled via flexible drive shaft 1270 to a drive wheel 1230 which is within a circular groove 1225 of ring 1220 to which asymmetric weight 1240 is attached. As indicated ring 1220 is mounted to a shaft via bearing 1260 allowing rotation of ring 1220 about its axis. Similarly, the drive wheel 1230 is mounted to a shaft and therein via bearing, not shown for clarity, to a fixed support. Accordingly, rotation of drive wheel 1230, which is in friction contact with the inner walls of the circular groove 1225, drives ring 1220 thereby causing it to rotate on bearing 1260 such that the asymmetric weight 1240 rotates yielding vibration. As the shaft for drive wheel 1230 is in this instance supported on the other side of the ring 1220 from the flexible drive shaft 1270 then the shaft passes through annular slot 1280. If the drive wheel 1230 drive shaft were supported solely on the same side as the flexible drive shaft 1270 through a bearing and mounting without the shaft passing through the drive wheel 1230 then this annular slot 1280 would not be required, such as depicted in FIG. 12B wherein the drive wheel is now a gear and the outer wall of circular groove 1225 now has gear teeth.

Figure 13:
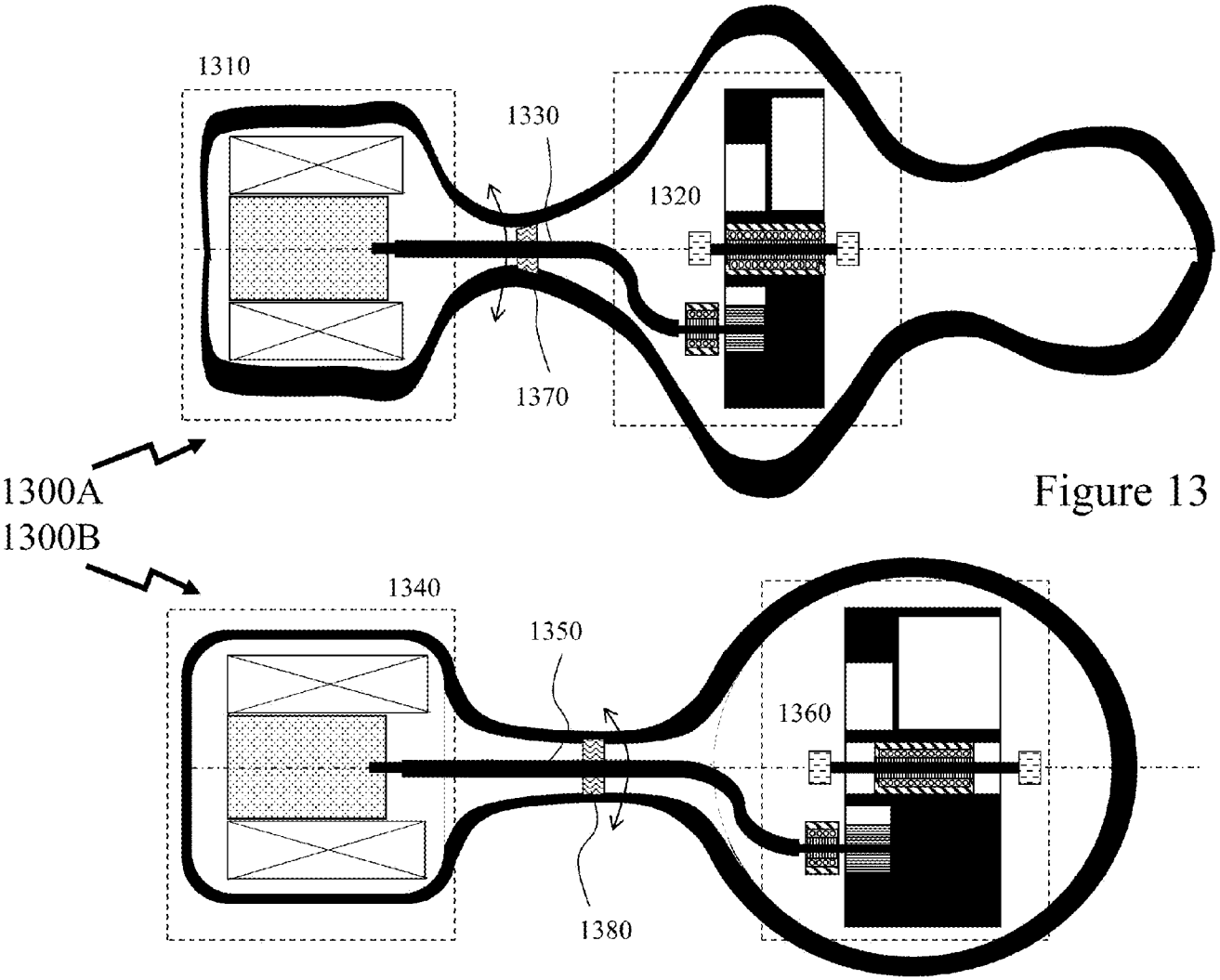
FIGS. 13 and 14 depict adult devices exploiting embodiments of the invention.

However, the drive shaft of the drive wheel 1230 where it does pass through the ring 1220 may then be used to couple to a subsequent assembly with ring 1220 such as depicted in FIG. 7 or 11 respectively. Optionally, the drive wheel 1230 may be replaced with a drive gear and one or both of the radial walls of the circular groove 1225 may be grooved such that the ring 1220 is gear driven. Referring to FIG. 13 there are depicted first and second adult devices 1300A and 1300B respectively exploiting vibratory elements incorporating reduction assemblies as described supra in respect of FIG. 12B wherein each comprises a power section 1310/1340 incorporating a high speed motor, battery, control circuit (not shown for clarity), user control(s) (not shown for clarity), etc. and device portion comprising asymmetric weight vibratory motors 1320/1360 respectively. The power section 1310/1340 and asymmetric weight vibratory motors 1320/1360 respectively are coupled via flexible drive shaft 1330/1350 such that the neck regions 1370/1380 may be deformable/small allowing relative angular motion between the power section 1310/1340 and asymmetric weight vibratory motors 1320/1360 respectively.

Within each of first and second adult devices 1300A and 1300B respectively the flexible drive shaft passes through a bushing/grommet which maintains the position of the flexible drive shaft relative to the other elements of the adult device. Accordingly, referring to first adult device 1300A the bushing 1370 positions the flexible drive shaft 1330 centrally at the narrow necked portion of first adult device 1300A. Accordingly, if the outer body allows the main vibrating body portion with asymmetric weight vibratory motor 1320 to bend relative to the power section 1310 the flexible drive shaft 1330 does not move, as in twist etc., within the power section 1310 but within the body portion containing asymmetric weight vibratory motor 1320. Similarly, bushing 1380 performs the same function within second adult device 1300B for the flexible drive shaft 1350 between the power section 1340 and asymmetric weight vibratory motor 1360.

Figure 14:
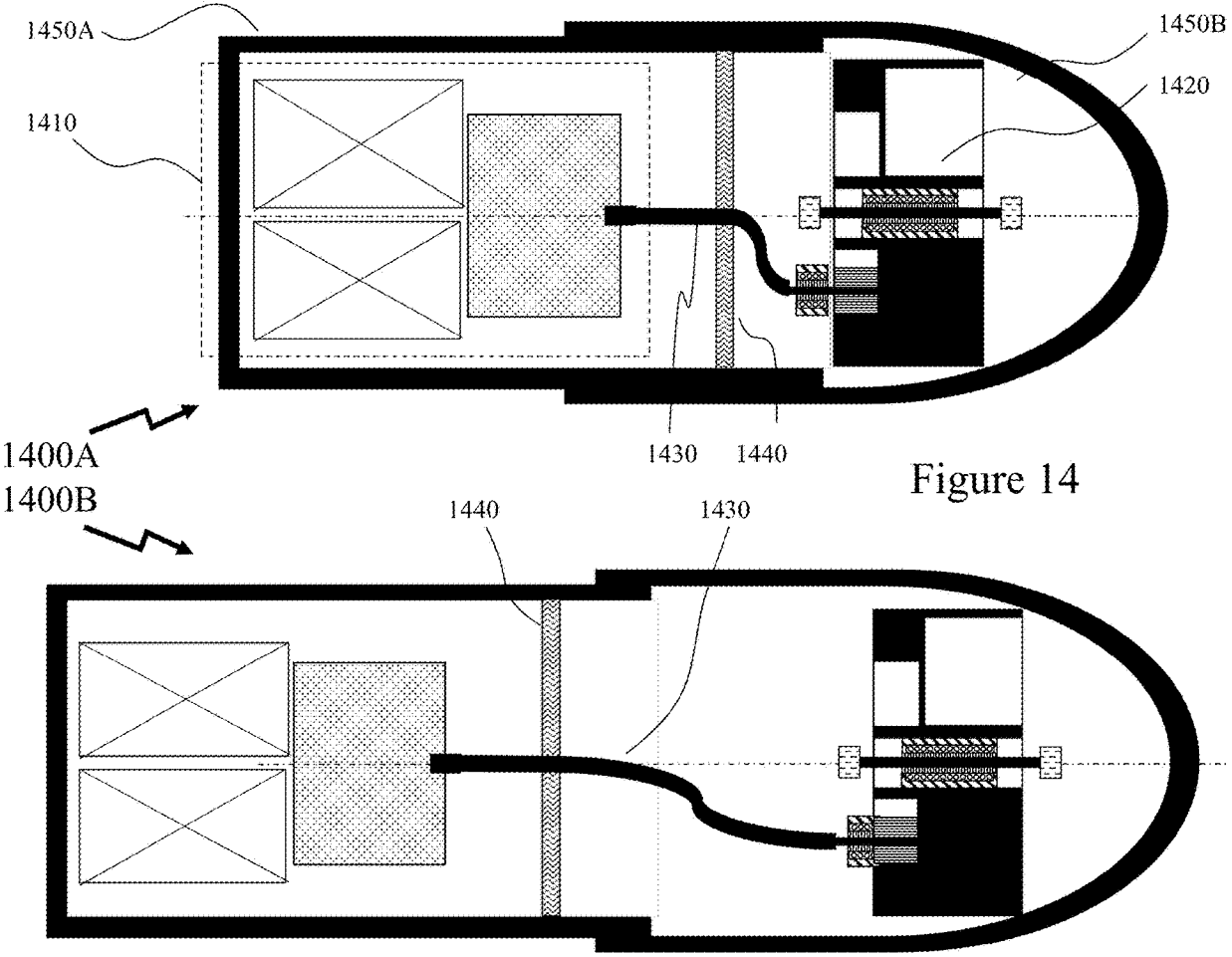

Alternatively, as depicted in FIG. 14 with extended and non-extended views 1400A and 1400B respectively an asymmetric weight vibratory motor 1420 may be positioned at different separations from the power section 1410 via a mechanism that allows for user device length setting in conjunction with an elastomeric and/or concertina skin of the outer body 1450, not shown for clarity, through the use of an elastomeric flexible drive shaft 1430. In this manner dimensions variations between the asymmetric weight vibratory motor 1420 and the power section 1410 are absorbed through the elastomeric flexible drive shaft 1430. For example, rotation of the end body section with the asymmetric weight vibratory motor 1420 may allow it to be decoupled from the main body section with power section 1410, slid, and then re-rotated to lock it. For example a regularly spaced series of spigots on an element of the main body section 1450A with the power section 1410 within may engage a regularly spaced series of slots on the end body section 1450B with the Alternatively, the end body section 1450B with the asymmetric weight vibratory motor 1420 may simply be rotated relative to the main body section 1450A with power section 1410, as these are coupled by a long pitch thread with interference fit such that the user may rotate deliberately but the adult device dimensions will not vary accidentally during use. It would be evident that other mechanical solutions to an extendible/retractable but locking assembly may be implemented discretely or in combination.

Figure 15:
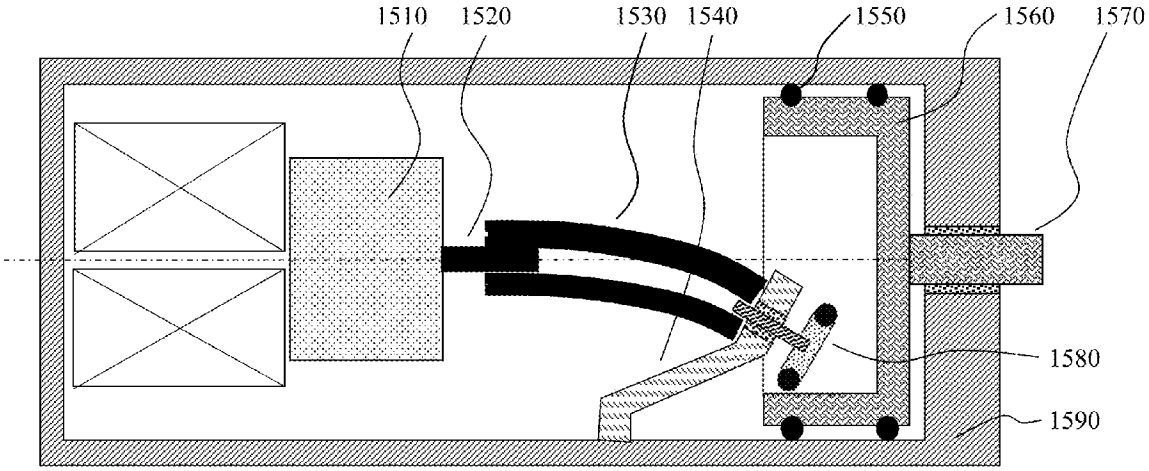
FIGS. 15 and 16 depict adult devices exploiting embodiments of the invention.
Figure 16:
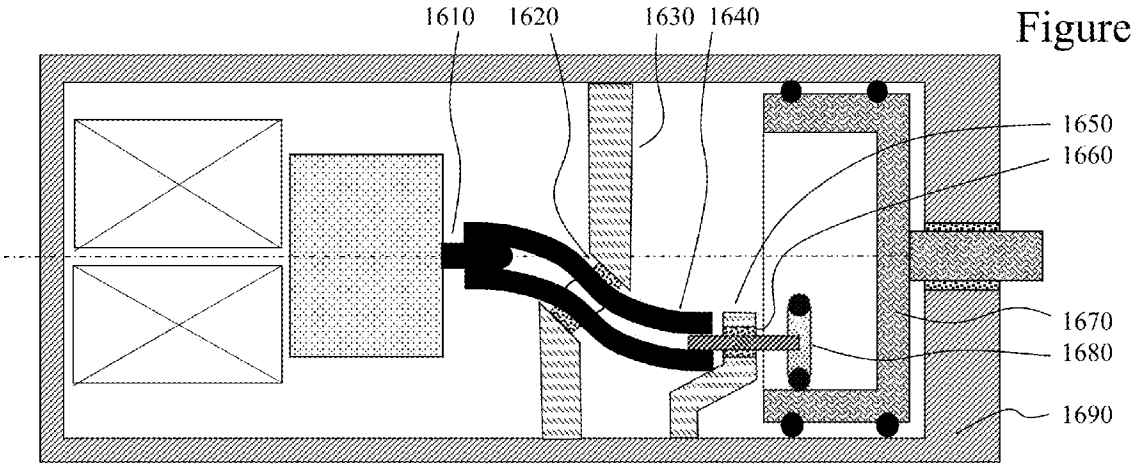

Within the preceding embodiments of the invention such as those depicted within FIGS. 3 to 7 and FIGS. 12A to 14 the flexible drive shaft has been primarily described as engaging the motor/asymmetric weight vibratory element parallel to the axis of the adult device. However, within other embodiments of the invention such as that depicted in FIG. 15 together with coupling mechanisms in FIGS. 21 and 22 adult devices exploiting embodiments of the invention may have an angular offset. Accordingly, referring to FIG. 15 there is depicted a cross-section of a portion of an adult device according to an embodiment of the invention wherein a flexible drive shaft 1530 couples from the shaft 1520 of an electric motor 1510 to drive wheel 1580 of a gear reduction drive where the drive wheel 1580 shaft is non-axial with the shaft 1520 of the motor 1510 and/or the adult device. Accordingly, the drive wheel 1580 engages on the inner surface of reduction drive 1560 which transmits the reduced gear drive via 1570 to another portion of the adult device. The drive wheel 1580 rotating with low friction within the body 1590 of the adult device due to the bearings 1550, discrete ball bearings for example or low friction rings for example. The shaft of the drive wheel 1580 is maintained in position through retaining arm 1540 which may comprise a bushing, not labeled for clarity. In FIG. 16 whilst the shaft 1610 and drive wheel 1680 are axially aligned and engage the reduction drive wheel 1670 within the body 1690 the shaft of the drive wheel 1680 is similarly retained by a first retaining arm 1650 with bushing 1660 but the flexible drive shaft 1640 is also retained by second bushing 1620 within second retaining arm 1630.

Within the embodiments presented supra the overall concept provides an inline gear reduction reducing the input RPM of typical motors within the range 10,000 to 20,000 RPM to an applied rotation rate reduced by an order of magnitude or more or by factors less than an order of magnitude. In embodiments of the invention a flexible drive shaft may drive the gear reducer within different configurations including, but not limited to those, depicted and described supra in respect of FIGS. 3 to 16. Within FIG. 16 a first common configuration is depicted which exploits a flexible drive shaft with a double bend or "S" shape in order to keep the axis of rotation of the input wheel parallel to the axis of rotation of the output wheel. To hold the input wheel in place and under pressure against the output wheel, the input wheel is help at the end of an arm that is compressed or tensioned to keep the desired pressure. This shape of the arm will vary depending on the material and pressure needed the keep the drive wheel in place against the reduction drive wheel. In such configurations the drive wheel and reduction drive wheel may have non-toothed surfaces, for example.

A second configuration is a single bend design such as depicted in FIG. 15 wherein, again, in order to hold the input wheel in place and under pressure against the output wheel, the input wheel is help at the end of an arm that is compressed or tensioned to keep the desired pressure. This shape of the arm will vary depending on the material and pressure needed the keep the drive wheel in place against the reduction drive wheel. The flexible drive shaft under certain conditions needs to be held in place to prevent it from flexing in undesirable ways.

The inventors exploited a simple experimental configuration to assess drive shaft geometries, materials, etc. wherein FIGS. 17 to 20 depict experimental measurements of embodiments of the invention with this simple experiment configuration. In essence the various drive wheel and reduction (or tread) wheel configurations were are added in the middle of a pair of motors. Once motor, the drive motor, powers the drive shaft which powers the drive wheel and makes the tread wheel turn which is connected to the load motor. In this configuration the two motors, drive wheel and tread wheel are held in place with mounts. The drive wheel was allowed to slide or pivot to allow for the contact pressure to be varied by the use of a counter weight or force gauge. Varying the force applied allows the contact area to vary in turn varying the friction between the drive wheel and the tread wheel. The friction is also varied by the shape of the drive wheel as well as its material, the shape and material of the tread wheel will affect the friction as well.

Figure 17:
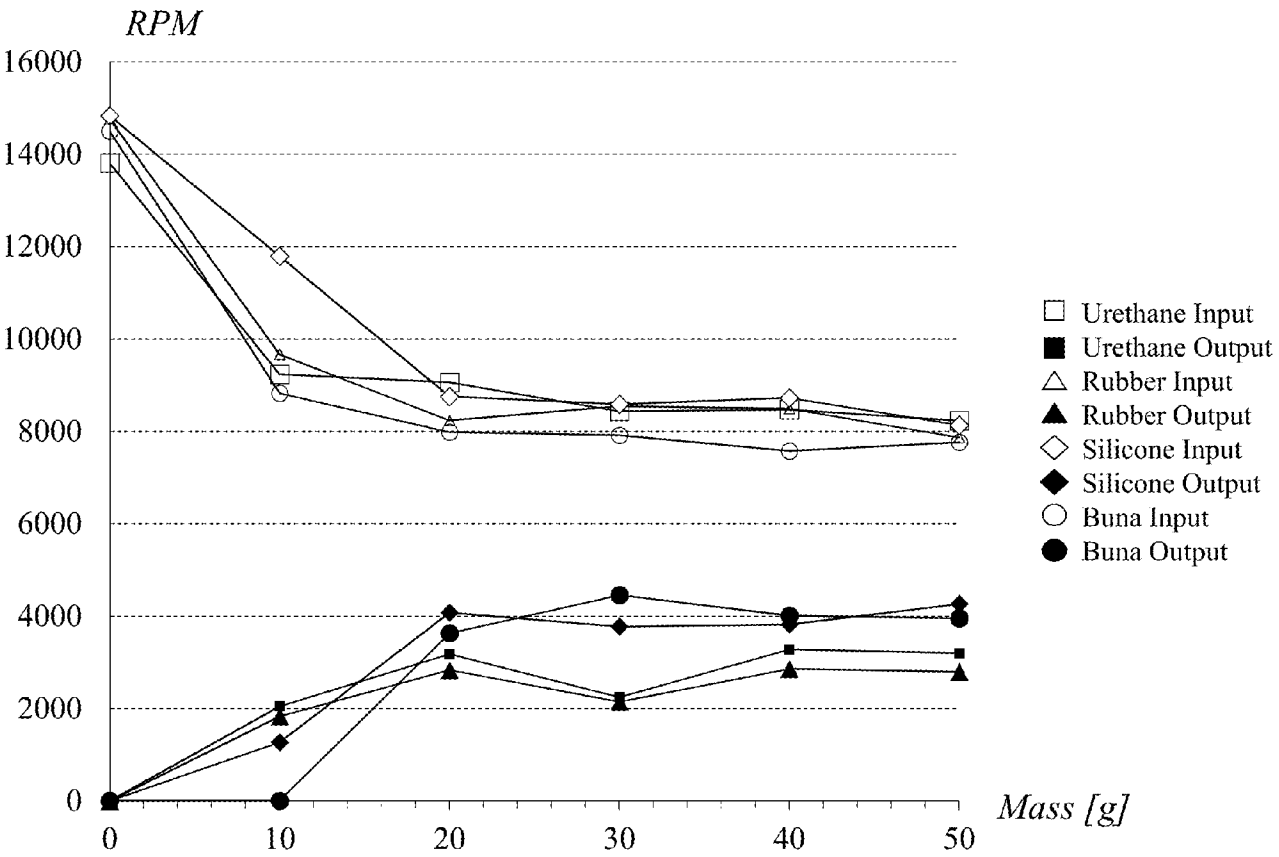
FIGS. 17 to 20 depict experimental measurements of embodiments of the invention.

The current in the drive motor can be measured and will vary depending on the power losses in the system. By measuring the initial current of the system and then the current while the test is running the difference between the two values can be calculated. When comparing these values the lower the better for current difference as there is less power draw for that specific configuration. If the output thread wheel rotation was zero despite operation of the drive motor it implies slipping of the drive wheel relative to the thread wheel as does a reduction ratio higher than that designed. Referring to FIG. 17 there are depicted experimental results for four different drive wheels relative to a thread (reduction) wheel, which had flat machined steel surfaces, for flat and circular drive wheels. The four drive wheels being:

Urethane (flat contact surface);

Natural rubber flat (flat contact surface);

Silicone (o-ring); and

Artificial rubber (buna o-ring).

Figure 18:
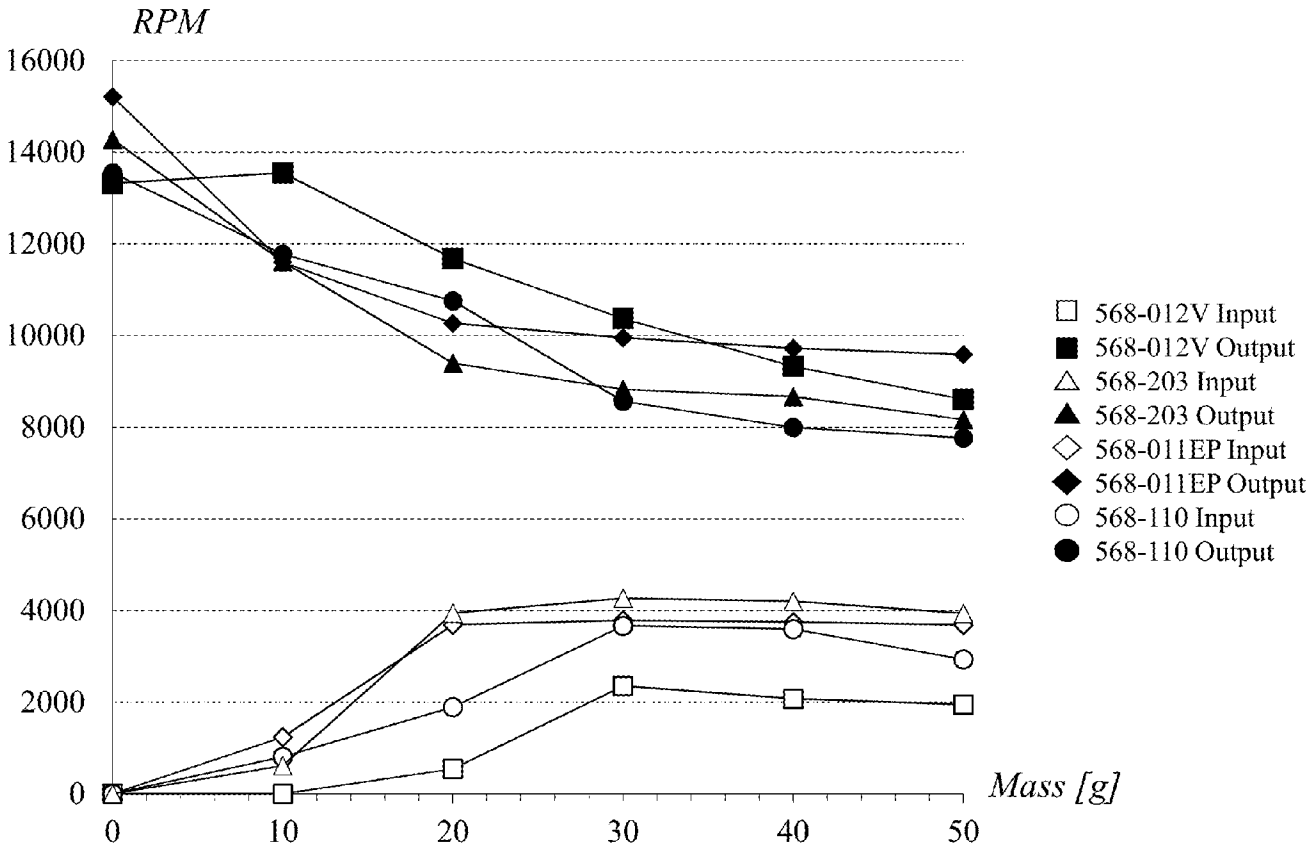

In each instance it is evident that approximately 20 g force is required for the tread wheel to be engaged fully by the drive wheel wherein the output rotation is ~3,00 RPM reduced from a loaded input rotation of ~8,500 RPM for the flat urethane and flat rubber versus an output rotation of ~4,000 for the silicone and buna o-rings. These achieved the approximately reduction of ~2:1 of the design configuration. Referring to FIG. 18 there are depicted further test results for different O-ring materials where in some instances, e.g. 568-110 and 568-012V the weight required for efficient drive coupling was 30 g. The overall characteristic in each case is to higher weight required for efficient coupling of the different O-rings relative to the materials employed in FIG. 17.

Figure 19:
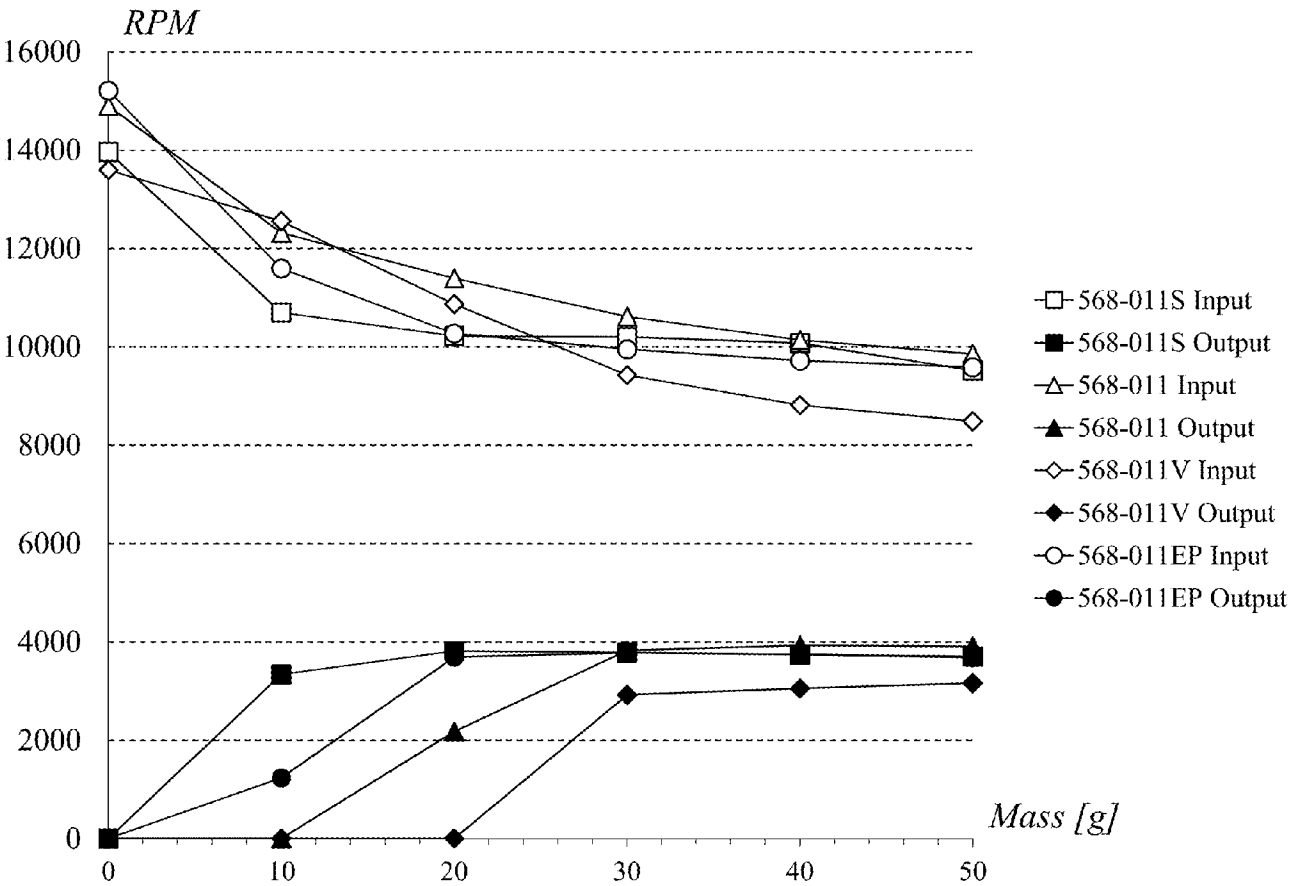

Now referring to FIG. 19 there are depicted the results for test configurations employing different materials on the flat steel tread wheel where a small in series load is employed in respect of determining motor speed, see for example the inventors in U.S. Provisional patent application XX/XXX, XXX filed YYYY YY, 2015 entitled "Multi-Motor Adult Devices and Control Methods." In each instance the material was an O-ring design and now slightly different behaviour is determined wherein one O-ring configuration (568-011S) reaches "efficient" coupling to the output at 10 g, one (568-011EP) at 20 g, and the others 30 g. The overall characteristics are similar to those in FIG. 18 rather than FIG. 17.

Figure 20:
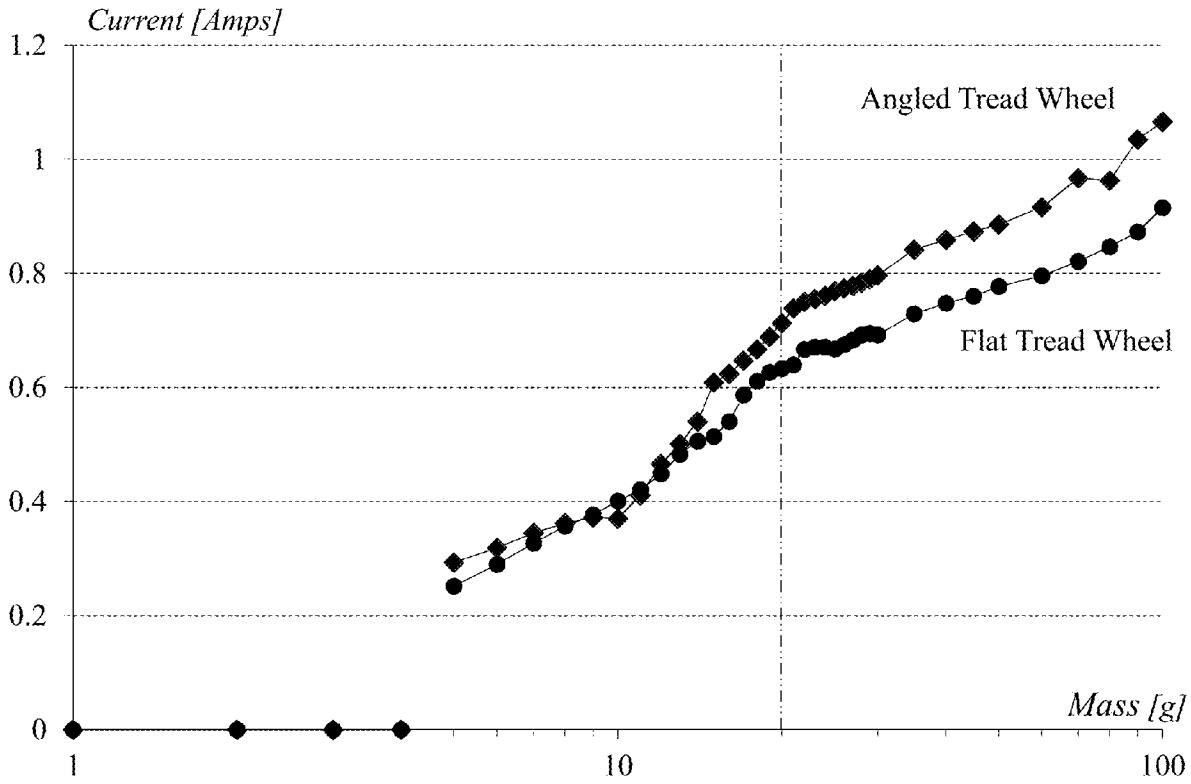

Now referring to FIG. 20 the current difference is plotted rather than input/output RPM for test configurations exploiting a flat tread (reduction) wheel and an angled tread wheel (see descriptions below in respect of FIGS. 21 and 22) wherein in each instance a single bend of 20° was applied to the drive shaft. In the former the drive wheel is at an angle to the flat tread wheel and in the latter the drive wheel is running in parallel to an angled tread wheel. As evident from approximately 20 g the increased current difference is approximately constant with the flat tread wheel configuration being more efficient.

Figure 21:
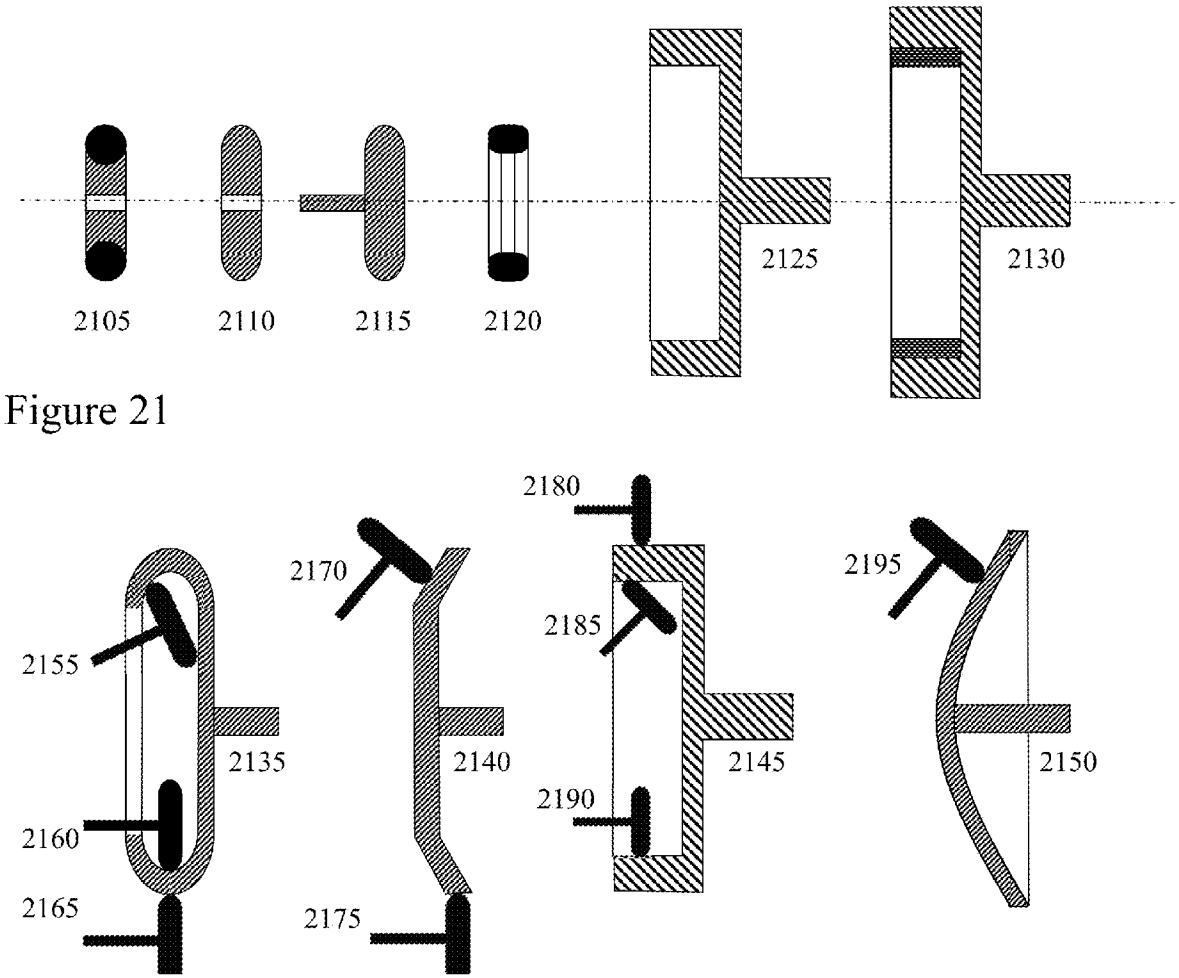
FIGS. 21 and 22 depict exemplary configurations of adult device components according to embodiments of the invention.

Now referring to FIG. 21 there are depicted construction configurations for drive wheels/reduction wheels according to embodiments of the invention. These represent a subset of potential configurations as would be evident to one of skill in the art. Considering initially the drive wheel then this may be combination of hub/rim with a tire, first image 2005, or a solid wheel, second image 2110, with similar profile as the hub/rim and tire design wherein the soft tire material is applied to the tread wheel instead of the drive wheel as depicted in first image 2105. As depicted in third image 2115 the drive wheel may have integral shaft or alternatively as depicted in essence with first and second images 2105 and 2110 the shaft may be a separate element and attached to the drive wheel. In first image 2105 the tire may be held in place by friction or permanently attached via glue, adhesive tape, etc. The shaft for attachment to the drive wheels of first and second images 2105 and 2110 may be, but not limited to, press fit, glued, welded, soldered, threaded, and retained by nut. The tire profile may vary from circular as depicted in first image 2105 to flat as depicted in fourth image 2120.

The reduction/tread wheel may be simply machined such as depicted in fifth image 2125 or have a material added around the surface engaged by the drive wheel, e.g. the inner surface as depicted in sixth image 2130 in FIG. 21. The material may be similarly glued into place, e.g. when a flat ribbon of material or otherwise retained, e.g. an O-ring held within a groove as known in the art. Optionally, the surface of the reduction/tread wheel may be machined and finished with a surface finish to promote engagement of the drive wheel, e.g. roughened, diamond turned, etc.

The geometry of the reduction wheel may vary as evident with first to fourth wheels 2135 to 2150 respectively. As depicted:

First wheel 2135 which is hollow and allows the drive wheel to engage as shown with first to third engagements 2155 to 2165 respectively which are angled inside, normal inside, and external;

Second wheel 2140 which is profiled to engage the drive wheel via fourth and fifth engagements 2170 and 2175 on the profiled edge and edge respectively;

Third wheel 2145 which is non-contoured and supports sixth to eighth engagements 2180 to 2190 respectively which are normal outside, angled inside, and normal inside; and Fourth wheel 2150 which has a curved profile supporting ninth engagement 2195 with the drive wheel.

Figure 22:
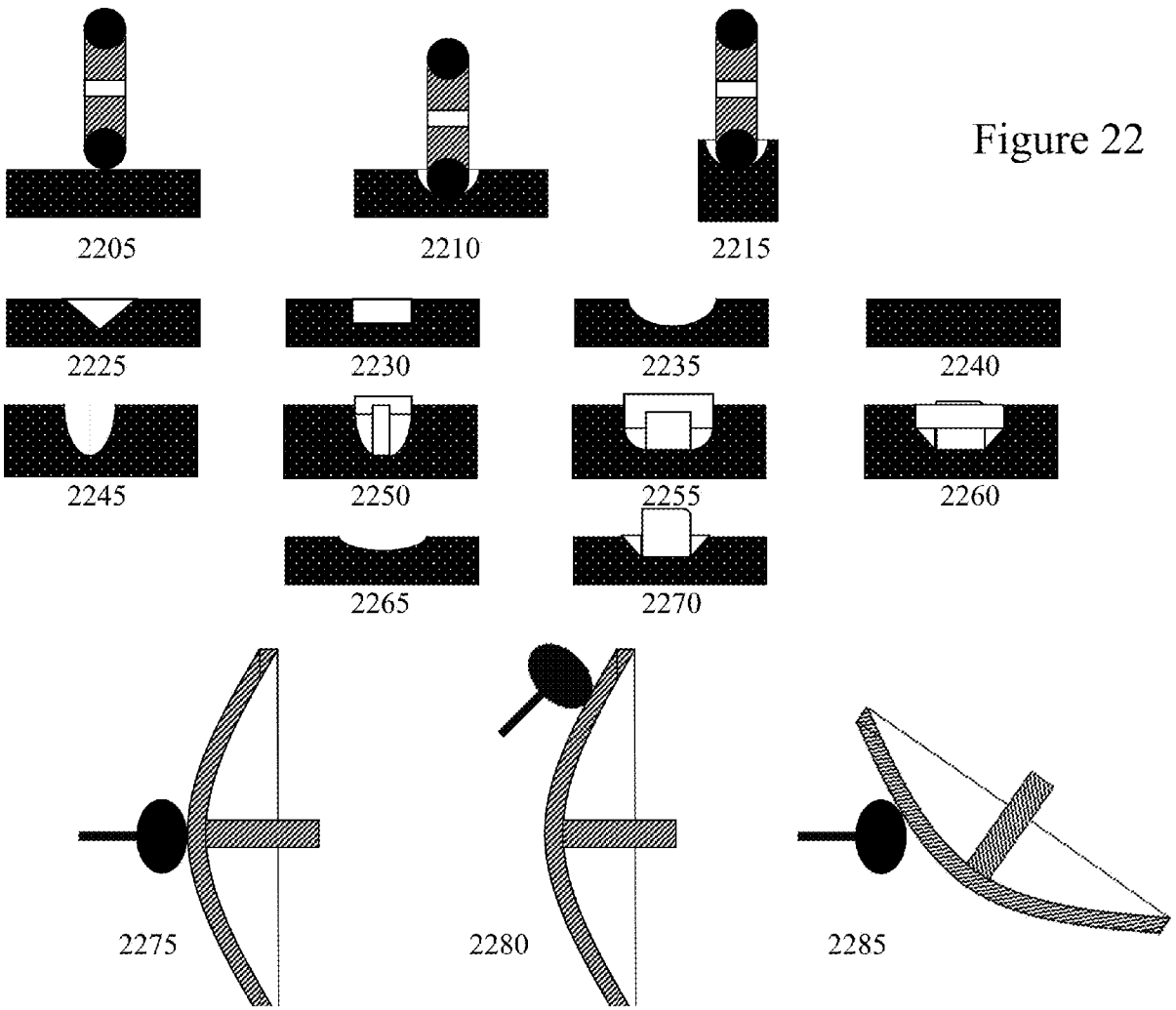

Now referring to FIG. 22 there are depict exemplary configurations of adult device components according to embodiments of the invention. Within first to third images 2205 to 2215 exemplary drive wheel to reduction wheel engagements are depicted with no surface profiling, side profiling, and edge profiling respectively. Examples of surface profiles to engage a drive wheel are depicted in first to tenth profiles 2225 to 2270 respectively. In some embodiments of the invention, such as depicted in first to third schematics 2275 to 2285, a drive wheel and reduction wheel may engage in multiple positions as the result of a reconfiguration of the mechanical relationship between the drive wheel and reduction wheel. In first schematic 2275 the two elements are aligned axially so that there is no reduction. However, in second and third schematics 2280 and 2285 the two elements are now non-axial such that a gear reduction is implemented. In second schematic 2280 the drive wheel is offset towards the outer edge of the reduction wheel by its movement off-axis whereas in third schematic 2285 the offset is achieved through a rotation of the reduction wheel relative to the drive wheel. In each instance a mechanical configuration may be made using flexible drive shafts such that, for example, shortening the length of an adult device pushes the reduction wheel against the drive wheel and flexible shaft bends to push the drive wheel to the outside of the reduction wheel. Such a configuration being, for example, supported by second schematic whilst optionally third schematic 2285 is supported by a user pushing a slider or other mechanical activator that rotates the reduction wheel within the adult device housing. Optionally, adjustment of these configurations may be mechanical or under electrical actuator control or a combination thereof.

Alternatively a cyclic linear drive, such as depicted and described in respect of FIG. 9, for example, may be used in conjunction with an asymmetric weight vibratory motor according to an embodiment of the invention, such as depicted and described in respect of FIGS. 2-5, 7-8, and 12A-12B, and one or more flexible drive shafts to provide a vibrating adult device with periodic extension/retraction. Alternatively, the asymmetric weight vibratory motor may be replaced with a periodically impacting vibrator motor, such as depicted for example in FIG. 6.

Any gear combination can be done also with wheels and smooth receiving mating surface. Rubber wheels can be designed to compress slightly with careful placement and provide good traction and long life. Wheels in many instances have the advantage over gears in that they tend to be quieter running and do not need lubrication. Accordingly, the inventors note that the embodiments of the invention described supra in respect of FIGS. 2 to 8 and FIG. 11 may be employed with wheels rather than gears. However, wheels can experience slippage while gears are locked and experience no slippage. Continuous or highly frequent slippage wastes some power and should be minimized.

Some energy is wasted in heat due to the wheel deforming as it rolls over the smooth mating surface. The mating surface can have a mat or textured surface finish that optimizes traction of the wheel to minimize the "load" that the wheel needs to exert on the matting surface in order to not slip. Decreasing the wheel load and subsequent wheel deformation will reduce wasted energy in the form of heat. Both the wheel (gear) and the mating drive surface (gear) can be made of many combinations of a variety of plastics, synthetics rubbers, urethanes and many metals. In both instances of wheels and gears designs with low friction materials can provide for designs with high lifetime, high efficiency and without the requirement for lubricants. However, in other embodiments of the invention lubricants may be employed either as surface treatments or in bulk.

Appropriate selection of materials and design can provide long life and quiet operation with either wheeled or gear based systems that run dry or with the use of sintered bushings and thin oil films or the use of oil baths. All standard lubrication techniques can be employed for both the shaft and bushings as well as the gear or wheel drive systems. For long life (low wear) wheel and receiving surface can also be made with both made from metal or both plastic and the use of small contact area and smooth polished surfaces and an oil lubricating film can be used because the thin film of oil between the two can achieve good traction. Through squeeze film lubrication techniques, the two parts have a high friction between them, but the parts do not actually touch each other. Wear is minimized as there is always a microscopic layer of oil between the two, typically metal, surfaces. In embodiments of the invention the bearings and shafts can be made from metal/plastic, or plastic/metal or dissimilar metal/metal or dissimilar plastic/plastic combinations. Likewise the (gear/wheel) and (gear/mating surface) components can be made from metal/plastic, or plastic/metal or (similar or dissimilar) metal/metal or (similar or dissimilar) plastic/plastic combinations.

Embodiments of the invention may exploit elastomers, natural rubbers, synthetic rubber for soft tires, e.g. tire around edge of wheel in first image 2110 or fourth image 2120 in FIG. 21, or soft material around the inner edge of reduction wheel such as depicted in sixth image 2130 in FIG. 21. Such materials may include, but are not limited to, Acrylonitrile-Butadiene; Carboxylated Nitrile; Ethylene Acrylate; Ethylene Propylene Rubber; Butyl Rubber; Chloroprene Rubber; Fluorocarbon; Fluorosilicone; Hydrogenated Nitrile; Perfluoroelastomer; Polyacrylate; Polyurethane; Silicone Rubber; and Tetrafluoroethylene-Propylene.

Embodiments of the invention may exploit metals and plastics for the hubs such as in first image 2110 or for the body of the reduction wheel such as depicted in fifth and sixth images 2125 and 2130 in FIG. 21. Such materials may include, but are not limited to: Steel; Stainless steel; Aluminum; Brass; Polyoxymethylene; Nylon; Polycarbonate; and Polypropylene.

Within the embodiments of the invention the flexible drive shaft may be formed from a variety of materials in their elastic range. Theses materials can also have different shapes. Using metal as an example a spring can be used as well as a solid bar or braided wire, such that almost any material could potentially be employed provided the requirement performance was within its conditions. Some of the materials that can be employed include, but are not limited to: plastic in solid rods or engineered shapes; Polyoxymethylene; Polyoxymethylene; Vesconite™; metal in solid rod or engineered shapes; Spring metal; Stainless steel wire in different sizes and braids, e.g. 7×7; 19×1, etc.; and Nickel titanium rods.

A specific shape of plastic that can be used for the flexible drive shaft without adapters is tubing. Materials may include, but are not limited to, Silicone, for example platinum cured or peroxide cured; Gum rubber; Synthetic rubber;

Fluorinated ethylene propylene; Perfluoropolymers such as MFA and PFA; Polyethylene; Polytetrafluoroethylene Polyvinyl chloride; and BPT.

Drive wheels, drive shafts, etc. may be supported by mounts that support the drive wheel, drive shaft, etc. on one side, both sides, with two bushings, one bushing or no bushings. A mount supported by an arm allows a constant pressure to be applied to keep the wheel in contact with the reduction gear/wheel. Bushings may be formed from a variety of materials including, but not limited to, sintered bronze, polyoxymethylene, Vesconite™, etc.

Embodiments of the invention may exploit a range of materials such as described within this specification including, for example, an embodiment of the invention, wherein:

steel motor shaft;

silicone tube as flexible drive shaft connecting motor shaft to reduction shaft;

steel "reduction shaft" that holds the reduction gear reduction gears made from plastic;

reduction shaft bushing(s) made from plastic;

steel "weight shaft" to be press fit into the off center weight;

off center weight made of tungsten;

weight shaft to ride in 1 or 2 plastic bushings; and weight "inner gear" to be plastic and press fit.

The plastic for the bushings and gears would be low surface friction material such as Vesconite or Acetal. Where drive shafts are described in conjunction with wheels, gears, etc. and these are attached to the drive shaft then it would be evident that such attachment may be implemented using a range of techniques including, but not limited to, key shaft, cotter pins, interference fit, spring clip retaining washer, tapered section retaining ring, self-locking retaining ring, screws, and threads shaft or threaded shaft sections and nuts. Shafts may be stamped or formed irregularly for attachment of wheel and/or gear through interference fit. Flexible drive shafts may, be connected and/or clamped to another element or inserted within an opening and clamped, e.g. jawed chucks, pinched, glued, epoxied, heat-shrunk, for example or a combination thereof.

Whilst emphasis has been made to self-contained discrete devices it would be evident that according to other embodiments of the invention that the device can be separated into multiple units, such as for example a vibrator element coupled to an inserted body via a flexible tube in order to either keep the vibrator element external to the user's body or as part of a flexible portion of the body allowing user adjustment such as arc of a vaginal penetrative portion of a device. Optionally, it would also be evident that devices according to embodiments of the invention can be configured to be held during use; fitted to a harness; fitted via an attachment to a part of the user's body or another user's body, e.g., hand, thigh, or foot; or fitted via a suction cup or other mounting means to a physical object such as a wall, floor, or table.

Within embodiments of the invention with respect to devices and the electronic control the descriptions supra in respect of the Figures have described electrical power for vibrator elements as being derived from batteries, either standard replaceable (consumable) designs such as alkaline, zinc-carbon, and lithium iron sulphide ($LiFeS_2$) types, or rechargeable designs such as nickel cadmium (NiCd or Nicad), nickel zinc, and nickel-metal hydride (NiMH). Typically, such batteries are AAA or AA although other battery formats including, but not limited to, C, D, and PP3. Accordingly, such devices would be self-contained with electrical power source, controller, and vibratory element(s) etc. all formed within the same body. It would be evident that the electronic controller and vibratory element(s) etc. are preferably low power, high efficiency designs when considering battery driven operation although electrical main connections can ease such design limits. In instances of wired interface remote controls and electrical mains connections then the cap may be fitted with an opening allowing the screw cap to be attached with the cable in a slot with rubber/elastomeric grommet/edge etc.

However, alternate embodiments of devices can be configured in so-called wand type constructions, see for example Hitachi Magic Wand within the prior art for example, wherein increased dimensions are typical but additionally the device includes a power cord and is powered directly from the electrical mains via a transformer. Optionally, a device can be configured with battery and electrical mains connections via a small electrical connector with a cord to a remote transformer and therein a power plug. Within embodiments of the invention to devices and the electronic control the descriptions supra in respect of the Figures the electrical control has been described as being within the device. However, optionally the controller can be remote to the device either connected via an electrical cable or communicating via an indirect means such as wireless communications for example. Additionally, the electronic controller has been primarily described as providing control signals to the active elements of the device. However, in some embodiments of the invention the electronic controller can receive inputs from sensors embedded within the device or external to the device. For example, a sensor can provide an output in dependence upon pressure applied to that portion of the device by the user, for example from vaginal contractions, wherein the controller can adjust one or more aspects of the device. Alternatively, the frequency of vibration may be varied based upon sensors within the body and/or handle of the adult device allowing the device's characteristics to be varied based upon the pressure applied by the user to the body and the user or another party to the handle. In other embodiments of the invention these sensors and/or control circuit.

Embodiments of the invention described supra in respect of FIGS. 2 to 14 may be employed within adult devices discretely or in combination with one or more other active and/or passive elements. Such elements may include, but not be limited, other vibratory elements, heating elements, cooling elements, fluidic actuators and fluidic elements, electrical stimulators, sets of metal and/or plastic balls, and screw drives. Additionally, whilst operation of the devices may have been described and/or inferred as being made under constant speed operation of the motor, albeit within a predetermined range of RPM, it would be evident that alternatively the drive of the asymmetric weight elements may be periodic, aperiodic, variable in frequency, have a predetermined profile, etc.

It would also be evident that whilst embodiments of the invention have been described with respect to single ratio reduction assemblies that alternate embodiments of the invention may allow for variable reduction assemblies. Accordingly, in one embodiment of the invention multiple heads, each comprising a different reduction ratio assembly, may be applied to a common body that contains the high speed motor, controller, and batteries for example. Alternatively, a design may provide the user with the ability to selectively engage one of a plurality of reduction assemblies, e.g. selecting a different drive gear to engage the same ring gear or selectively connecting the drive to an outer gear rather than an inner gear or the outer teeth of a ring gear rather than teeth on an inner element of the ring gear.

It would also be evident that whilst embodiments of the invention have been described with respect to asymmetric weights formed upon rotating elements of the ratio reduction assembly(ies) that an asymmetric weight may be applied to an output shaft of a ratio reduction assembly either alone or in combination with other asymmetric weights.

It would also be evident that whilst embodiments of the invention have been described with respect to asymmetric weights formed upon rotating elements that the rotating elements may impart other sensations to the user's body or the body of a user to whom the device is applied such as rotating sets of beads or ball bearings, rotating nubbies, etc.

Specific details are given in the above description to provide a thorough understanding of the embodiments. However, it is understood that the embodiments can be practiced without these specific details. For example, circuits can be shown in block diagrams in order not to obscure the embodiments in unnecessary detail. In other instances, well-known circuits, processes, algorithms, structures, and techniques can be shown without unnecessary detail in order to avoid obscuring the embodiments.

Implementation of the techniques, blocks, steps and means described above can be done in various ways. For example, these techniques, blocks, steps and means can be implemented in hardware, software, or a combination thereof. For a hardware implementation, the processing units can be implemented within one or more application specific integrated circuits (ASICs), digital signal processors (DSPs), digital signal processing devices (DSPDs), programmable logic devices (PLDs), field programmable gate arrays (FPGAs), processors, controllers, micro-controllers, microprocessors, other electronic units designed to perform the functions described above and/or a combination thereof.

Also, it is noted that the embodiments can be described as a process, which is depicted as a flowchart, a flow diagram, a data flow diagram, a structure diagram, or a block diagram. Although a flowchart can describe the operations as a sequential process, many of the operations can be performed in parallel or concurrently. In addition, the order of the operations can be rearranged. A process is terminated when its operations are completed, but could have additional steps not included in the figure. A process may correspond to a method, a function, a procedure, a subroutine, a subprogram, etc. When a process corresponds to a function, its termination corresponds to a return of the function to the calling function or the main function.

The foregoing disclosure of the embodiments of the present invention has been presented for purposes of illustration and description. It is not intended to be exhaustive or to limit the invention to the precise forms disclosed. Many variations and modifications of the embodiments described herein will be apparent to one of ordinary skill in the art in light of the above disclosure.

Further, in describing representative embodiments of the present invention, the specification may have presented the method and/or process of the present invention as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process of the present invention should not be limited to the performance of their steps in the order written, and one skilled in the art can readily appreciate that the sequences may be varied and still remain within the spirit and scope of the present invention.

What is claimed is:

1. A device for sexual stimulation comprising:

a motor providing rotary motion at a first predetermined rotation rate;

a flexible drive shaft coupled between the motor and a drive wheel such that the drive wheel rotates at the first predetermined rotation rate;

a radial element mechanically in contact with the drive wheel for converting the rotary motion of the drive wheel at a first rotation rate to rotary motion at a second predetermined rotation rate lower than the first predetermined rotation rate; and an asymmetric annular weight coupled to the radial element to impart mechanical vibratory action to a user when rotated at the second predetermined rotation rate; wherein either the drive wheel is mechanically coupled to a first body portion such that at least one of a relative linear position and a relative angular orientation of the drive wheel relative to the radial element arising from adjusting a second body portion comprising the radial element relative to the first body portion results in varying, and adjusting a ratio between the first predetermined rotation rate and the second predetermined rotation rate;

or the drive wheel is mechanically coupled to a third body portion which also comprises the drive wheel such that a relative linear position and a relative angular orientation of the third body portion relative to a remainder of the device does not result in the position of the drive wheel relative to the radial element varying such that the ratio between the first predetermined rotation rate and the second predetermined rotation rate does not change.

2. The device for sexual stimulation according to claim 1, wherein the device for sexual stimulation has a first configuration or a second configuration; wherein in the first configuration:

the flexible drive shaft is a single arc such that an axis of the drive wheel is at a first predetermined angle to a surface of the radial element to which it engages;

the drive wheel is attached to a body of the device via a first mounting such that the drive wheel exerts force against the radial element whilst transferring rotary motion from the drive wheel to the radial element; and the surface of the radial element is at least one of an outer edge, an inner edge, an inner surface, and an outer surface; and in the second configuration:

the flexible drive shaft is an s-bend or dual arc such that the axis of the drive wheel is at a second predetermined angle to the surface of the radial element to which it engages;

the drive wheel is mechanically coupled to the body of the device such that the drive wheel exerts force against the radial element whilst transferring rotary motion from the drive wheel to the radial element; and the surface of the radial element to which the drive wheel is mechanically coupled is selected from the group comprising an outer edge, an inner edge, an inner surface, and an outer surface.

3. The device for sexual stimulation according to claim 1, wherein the first body portion of the device incorporates the motor and a first portion of a coupling between the first body portion of the device and the second body portion of the device; and the second body portion of the device incorporates the drive wheel, the radial element, the asymmetric annular weight and a second portion of the coupling between the first body portion and the second body portion of the device; wherein the device has a first configuration and a second configuration wherein at least one of a relative linear position of the first body portion and the second body portion and a relative angular orientation of the first body portion relative to the second body portion are different in the first configuration and the second configuration; and the flexible drive shaft is enclosed within the device as formed by the first body portion of the device and the second body portion of the device.

4. The device for sexual stimulation according to claim 1, wherein the first predetermined rotation rate of the motor is within the range 10,000 RPM$\leq f_{ROTATION} \leq$30,000 RPM and the second predetermined rotation rate of the radial element is within the range 2,000 RPM$\leq v_{VIBRATION} \leq$7,000 RPM.

5. The device for sexual stimulation according to claim 1, wherein a reduction assembly comprising the drive wheel and the radial element is coupled to the motor via the drive shaft and the drive wheel for reducing an output rotation rate of the motor by a predetermined ratio;

the asymmetric annular weight is coupled to the reduction assembly to impart motion to a predetermined portion of the device; and the radial element is axially mounted via a bearing and shaft having a groove formed within a surface within which the drive wheel fits and drives the radial element by friction based mechanical contact; and the predetermined ratio is established in dependence upon the circumference of the groove and the circumference of the drive wheel.

6. The device for sexual stimulation according to claim 1, wherein the asymmetric annular weight is driven by the radial element and provides for mechanical vibratory motion that is either continuous, periodic, or in a single direction.

7. The device for sexual stimulation according to claim 1, further comprising a reduction assembly comprising:

a first reduction drive coupled to a rotating shaft of the motor and comprising a first output shaft having a rotation rate at a first predetermined ratio relative to the rotating shaft of the motor; and a second reduction drive coupled to the first output shaft and comprising a second output shaft having a rotation rate at a second predetermined ratio relative to the rotation rate of the first output shaft; wherein the drive wheel and the radial element form part of the reduction assembly; and the asymmetric annular weight is at least one of coupled to the second output shaft; forms a predetermined portion of the second reduction drive; and forms a predetermined portion of the first reduction drive.

8. The device for sexual stimulation according to claim 1, wherein the motor is mounted within a first part of the device;

the radial element is mounted within a second part of the device which is pivotably attached to the first part of the device; and a surface against which the drive wheel mechanically contacts to drive the radial element is either convex or concave; wherein pivoting the second part of the device relative to the first part of the device results in a radius of contact of the drive wheel with the radial element varying such that the ratio of the second predetermined rotation rate of the radial element to the first predetermined rotation rate of the motor is established in dependence upon the radius of the drive wheel and the radius of contact of the drive wheel with the radial element.

9. The device for sexual stimulation according to claim 1, wherein the drive wheel comprises an outer surface around the perimeter of the drive wheel formed from a first predetermined material;

the radial element comprises a body with a feature having a surface against which the drive wheel engages and is formed from a second predetermined material; and the asymmetric annular weight is disposed around a predetermined portion of the perimeter of the radial element, wherein the surface of the feature of the radial element is frictionally engaged with the outer surface of the drive wheel and is formed from a third predetermined material such that a relative angular orientation of the drive wheel and the radial element can vary without interrupting operation of the device.

10. The device for sexual stimulation according to claim 1, wherein the device for sexual stimulation can be configured between a first configuration and a second configuration; wherein in the first configuration an axis of the drive wheel is at a first predetermined angle to a surface of the radial element to which it engages and the drive wheel engages at a first predetermined position on the surface of the radial element such that the second predetermined rotation rate has a first reduction ratio relative to the first rotation rate; and in the second configuration the axis of the drive wheel is at a second predetermined angle to the surface of the radial element to which it engages and the drive wheel engages at a second predetermined position on the surface of the radial element such that the second predetermined rotation rate has a second reduction ratio relative to the first rotation rate; and the drive wheel is mechanically coupled to a body of the device such that the drive wheel exerts at least a minimum predetermined force against the radial element whilst transferring rotary motion from the drive wheel to the radial element.

11. A device for sexual stimulation comprising:

a motor providing rotary motion at a first predetermined rotation rate;

a flexible drive shaft coupled between the motor and a drive wheel such that the drive wheel rotates at the first predetermined rotation rate;

a radial element mechanically in contact with the drive wheel for converting the rotary motion of the drive wheel at a first rotation rate to rotary motion at a second predetermined rotation rate lower than the first predetermined rotation rate; and an asymmetric annular weight coupled to the radial element to impart mechanical vibratory action to a user when rotated at the second predetermined rotation rate wherein a reduction assembly comprising the drive wheel and the radial element is coupled to the motor via the drive shaft and the drive wheel for reducing an output rotation rate of the motor by a predetermined ratio;

the asymmetric annular weight is coupled to the reduction assembly to impart motion to a predetermined portion of the device; and the radial element is axially mounted via a bearing and shaft having a groove formed within a surface within which the drive wheel fits and drives the radial element by friction based mechanical contact; and the predetermined ratio is established in dependence upon the circumference of the groove and the circumference of the drive wheel.

12. A device for sexual stimulation comprising:

a motor providing rotary motion at a first predetermined rotation rate;

a flexible drive shaft coupled between the motor and a drive wheel such that the drive wheel rotates at the first predetermined rotation rate;

a radial element mechanically in contact with the drive wheel for converting the rotary motion of the drive wheel at a first rotation rate to rotary motion at a second predetermined rotation rate lower than the first predetermined rotation rate;

an asymmetric annular weight coupled to the radial element to impart mechanical vibratory action to a user when rotated at the second predetermined rotation rate; and a reduction assembly comprising:

a first reduction drive coupled to a rotating shaft of the motor and comprising a first output shaft having a rotation rate at a first predetermined ratio relative to the rotating shaft of the motor; and a second reduction drive coupled to the first output shaft and comprising a second output shaft having a rotation rate at a second predetermined ratio relative to the rotation rate of the first output shaft; wherein the drive wheel and the radial element form part of the reduction assembly; and the asymmetric annular weight is at least one of coupled to the second output shaft; forms a predetermined portion of the second reduction drive; and forms a predetermined portion of the first reduction drive.

13. A device for sexual stimulation comprising:

a motor providing rotary motion at a first predetermined rotation rate;

a flexible drive shaft coupled between the motor and a drive wheel such that the drive wheel rotates at the first predetermined rotation rate;

a radial element mechanically in contact with the drive wheel for converting the rotary motion of the drive wheel at a first rotation rate to rotary motion at a second predetermined rotation rate lower than the first predetermined rotation rate; and an asymmetric annular weight coupled to the radial element to impart mechanical vibratory action to a user when rotated at the second predetermined rotation rate; wherein the motor is mounted within a first part of the device;

the radial element is mounted within a second part of the device which is pivotably attached to the first part of the device; and a surface against which the drive wheel mechanically contacts to drive the radial element is either convex or concave; wherein pivoting the second part of the device relative to the first part of the device results in a radius of contact of the drive wheel with the radial element varying such that a ratio of the second predetermined rotation rate of the radial element to the first predetermined rotation rate of the motor is established in dependence upon the radius of the drive wheel and the radius of contact of the drive wheel with the radial element.

14. A device for sexual stimulation comprising:

a motor providing rotary motion at a first predetermined rotation rate;

a flexible drive shaft coupled between the motor and a drive wheel such that the drive wheel rotates at the first predetermined rotation rate;

a radial element mechanically in contact with the drive wheel for converting the rotary motion of the drive wheel at a first rotation rate to rotary motion at a second predetermined rotation rate lower than the first predetermined rotation rate; and an asymmetric annular weight coupled to the radial element to impart mechanical vibratory action to a user when rotated at the second predetermined rotation rate; wherein the drive wheel comprises an outer surface around the perimeter of the drive wheel formed from a first predetermined material;

the radial element comprises a body with a feature having a surface against which the drive wheel engages and is formed from a second predetermined material; and the asymmetric annular weight is disposed around a predetermined portion of the perimeter of the radial element, wherein the surface of the feature of the radial element is frictionally engaged with the outer surface of the drive wheel and is formed from a third predetermined material such that a relative angular orientation of the drive wheel and radial element can vary without interrupting operation of the device.

15. A device for sexual stimulation comprising:

a motor providing rotary motion at a first predetermined rotation rate;

a flexible drive shaft coupled between the motor and a drive wheel such that the drive wheel rotates at the first predetermined rotation rate;

a radial element mechanically in contact with the drive wheel for converting the rotary motion of the drive wheel at a first rotation rate to rotary motion at a second predetermined rotation rate lower than the first predetermined rotation rate; and an asymmetric annular weight coupled to the radial element to impart mechanical vibratory action to a user when rotated at the second predetermined rotation rate; wherein the device for sexual stimulation can be configured between a first configuration and a second configuration; wherein in the first configuration an axis of the drive wheel is at a first predetermined angle to a surface of the radial element to which it engages and the drive wheel engages at a first predetermined position on the surface of the radial element such that the second rotation rate has a first reduction ratio relative to the first rotation rate; and in the second configuration the axis of the drive wheel is at a second predetermined angle to the surface of the radial element to which it engages and the drive wheel engages at a second predetermined position on the surface of the radial element such that the second rotation rate has a second reduction ratio relative to the first rotation rate; and the drive wheel is mechanically coupled to a body of the device such that the drive wheel exerts at least a minimum predetermined force against the radial element whilst transferring rotary motion from the drive wheel to the radial element.

* * * * *